US012698607B2

(12) United States Patent
Hudson

(10) Patent No.: US 12,698,607 B2
(45) Date of Patent: Aug. 4, 2026

(54) FLEXIBLE TENSIONED CRASH BARRIER

(71) Applicant: David Marshall Hudson, Auckland (NZ)

(72) Inventor: David Marshall Hudson, Auckland (NZ)

(73) Assignee: ROBOS INTERNATIONAL LIMITED, Auckland (NZ)

( * ) Notice: Subject to any disclaimer, the term of this patent is extended or adjusted under 35 U.S.C. 154(b) by 1089 days.

(21) Appl. No.: 17/767,781

(22) PCT Filed: Oct. 9, 2020

(86) PCT No.: PCT/IB2020/059484

§ 371 (c)(1),
(2) Date: Apr. 8, 2022

(87) PCT Pub. No.: WO2021/070122

PCT Pub. Date: Apr. 15, 2021

(65) Prior Publication Data

US 2024/0117579 A1 Apr. 11, 2024

(30) Foreign Application Priority Data

Oct. 9, 2019 (NZ) ..... 757996
Apr. 29, 2020 (NZ) ..... 764015

(51) Int. Cl.
*E01F 15/06* (2006.01)
*E01F 15/14* (2006.01)

(52) U.S. Cl.
CPC ..... *E01F 15/06* (2013.01); *E01F 15/143* (2013.01); *E01F 15/146* (2013.01)

(58) Field of Classification Search
None
See application file for complete search history.

(56) References Cited

U.S. PATENT DOCUMENTS 1,890,751 A 12/1932 Russell
2,213,239 A * 9/1940 Camp ..... E01F 15/0438 256/13.1

(Continued)

FOREIGN PATENT DOCUMENTS

CN 109898209 A 6/2019
CN 111287124 A 6/2020

(Continued)

OTHER PUBLICATIONS

Supplementary Partial European Search Report dated Nov. 24, 2023 for European Application No. 20873503.5.

(Continued)

*Primary Examiner* — Christopher J Sebesta
*Assistant Examiner* — Katherine J Chu
(74) *Attorney, Agent, or Firm* — JCIP; Joseph G. Chu

(57) ABSTRACT

A roadside crash barrier configured for deflecting errant vehicles towards the road. The barrier comprising at least one tensioned flexible strap comprising a planar face facing the road in use. Compared to prior art systems, the present invention reduces the chances of injury to motorcyclists, as well as being fast and easy to install. A collapsible end anchor for holding the tension of the straps is also described herein, where the end anchor is configured to reduce vehicle rollover should end on impact occur whilst still retaining the effectiveness of the retained road barrier.

19 Claims, 26 Drawing Sheets

(56) References Cited

U.S. PATENT DOCUMENTS

Figure 1:
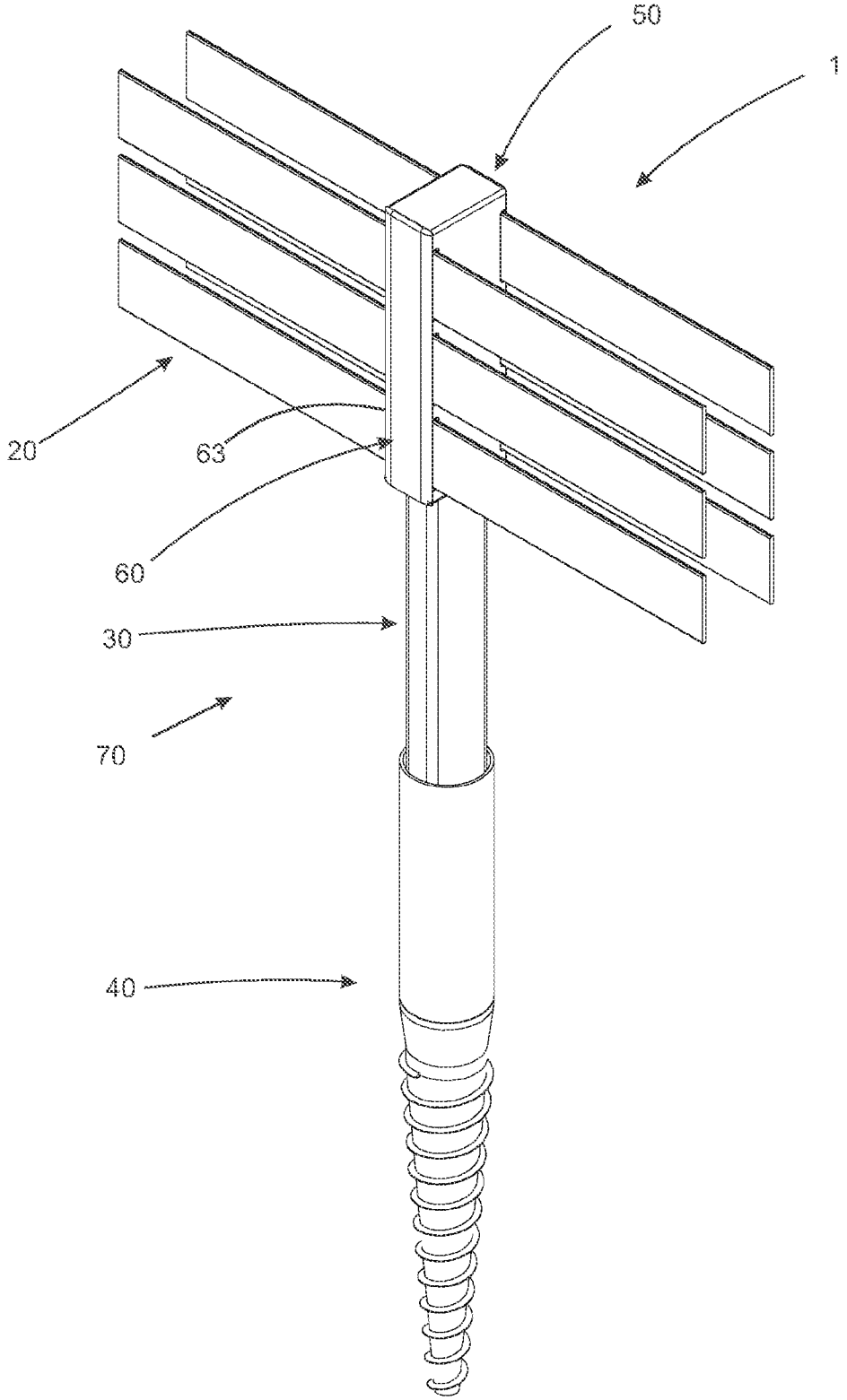

| | | | | | |
|---|---|---|---|---|---|
| 2,238,523 | A * | 4/1941 | Holst | E01F 15/06 | 256/56 |
| 2,349,648 | A * | 5/1944 | Brickman | E01F 15/06 | 248/66 |
| 3,353,795 | A * | 11/1967 | Muller | E01F 15/06 | 52/298 |
| 6,789,979 | B1 * | 9/2004 | Jones | E01F 15/06 | 404/6 |
| 7,398,960 | B2 * | 7/2008 | Neusch | E01F 15/06 | 256/48 |
| 8,206,056 | B2 * | 6/2012 | O'Banion | E01F 15/06 | 404/6 |
| 8,491,216 | B2 * | 7/2013 | Dyke | E01F 15/146 | 404/6 |
| 8,596,617 | B2 * | 12/2013 | James | E01F 15/143 | 256/13.1 |
| 8,757,597 | B2 * | 6/2014 | James | E01F 15/06 | 404/6 |
| 9,234,324 | B2 * | 1/2016 | Tonks | E04H 17/08 | |
| 11,591,760 | B2 * | 2/2023 | Allington | E01F 15/06 | |
| 12,054,899 | B2 * | 8/2024 | Wieczorek | E01F 15/06 | |
| 2003/0015695 | A1 * | 1/2003 | Alberson | E01F 15/0476 | 256/13.1 |
| 2007/0102689 | A1 * | 5/2007 | Alberson | E01F 15/06 | 256/13.1 |
| 2010/0200826 | A1 * | 8/2010 | Olsson | E04H 17/12 | 256/48 |
| 2011/0095252 | A1 | 4/2011 | Dyke et al. | | |
| 2017/0268189 | A1 * | 9/2017 | Heinevik | E04H 17/12 | |
| 2021/0310206 | A1 * | 10/2021 | Wieczorek | E01F 15/06 | |

FOREIGN PATENT DOCUMENTS

| | | | | |
|---|---|---|---|---|
| DE | 1273557 | B | 7/1968 | |
| GB | 2466878 | A * | 7/2010 | E04H 17/12 |
| KR | 20180025019 | A | 3/2018 | |
| WO | 2010144932 | A1 | 12/2010 | |

OTHER PUBLICATIONS

International Search Report dated Dec. 14, 2020 and Written Opinion of International Searching Authority dated Dec. 14, 2020 for International Application No. PCT/IB2020/059484.

International Preliminary Report on Patentability dated Jul. 30, 2021 for International Application No. PCT/IB2020/059484.

* cited by examiner

FIGURE 14
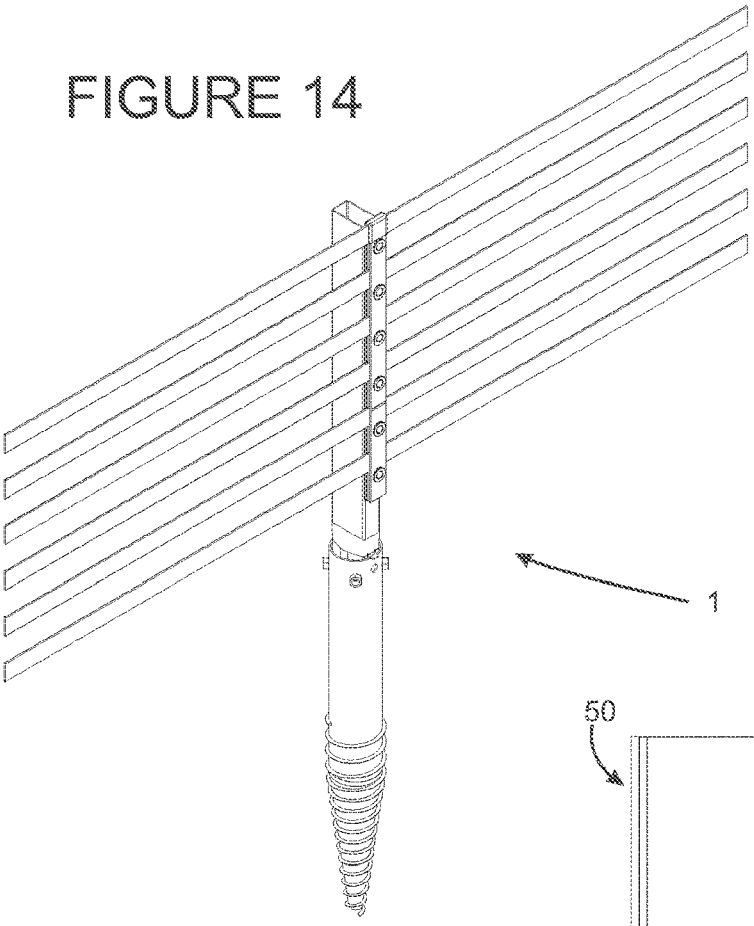
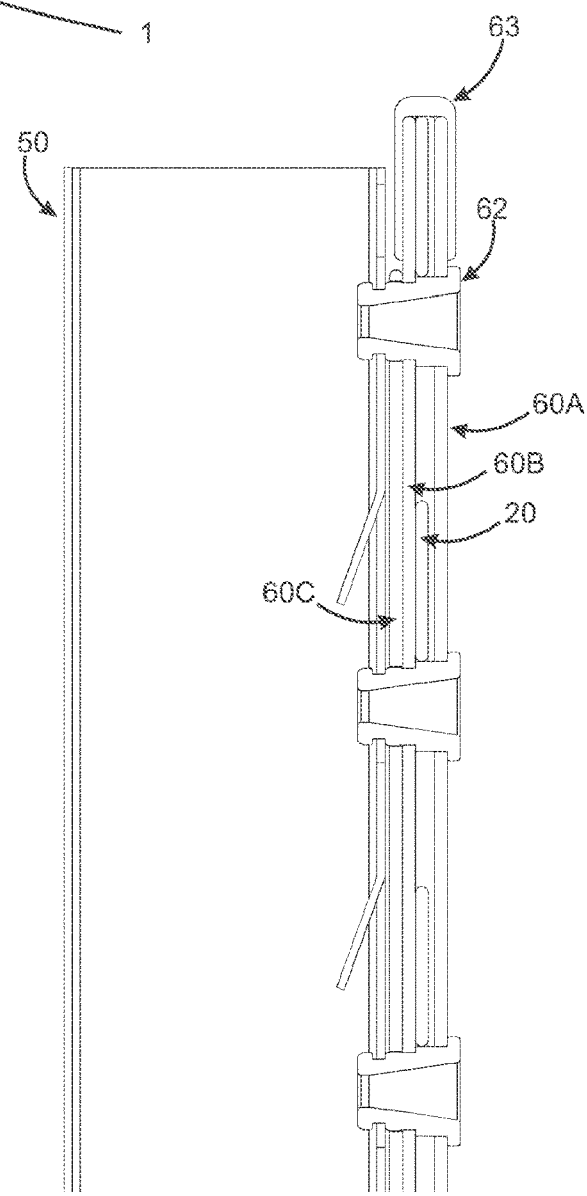
FIGURE 15

FLEXIBLE TENSIONED CRASH BARRIER

The present invention relates to a flexible tensioned crash barrier. More particularly but not exclusively it relates to a crash barrier for roadside use that utilises a flexible strap under tension that has a planar surface facing the road.

BACKGROUND

Flexible tensioned wire rope barriers have been used for many years as an economical solution for road safety. They are typically used on the side of, or in between, lanes of a road. If an errant vehicle impacts the barrier, the flexible wire ropes may be able to redirect the errant vehicle back towards the lane it came from. For car and truck occupants, this solution has reduced the risk of injury from an accidental collision with oncoming traffic, as well as from any vehicle leaving the roadway. These traditional wire rope barriers utilise an upright post which is configured to disengage or break near the ground so that the vehicle does not roll when it hits or impacts the upright. The wire ropes may be able to become disengaged from the upright upon impact of a vehicle to the crash barrier.

The upright is designed to bend upon vehicle impact and release the flexible barrier; typically, this allows the barrier/wire ropes to deflect by 1-2 metres during the process of redirecting the errant vehicle. Flexible barriers typically have the benefit of redirecting or absorbing energy from the errant vehicle.

In operation, the upright may provide strong resistance to longitudinal movement (vertical) of the barrier wires, but weak resistance to the lateral (side) impact from an errant vehicle. This may allow an upright to give way under the impact. The tensioned wires, combined with the sacrificial uprights may allow good directional correction of an errant vehicle without causing a vehicle to roll.

Flexible wire rope barriers may be dangerous for motorcycle users and cycle users (riders). The low cross-sectional area of the wire rope in tension may create a high pressure point should an errant user of a motorcycle impact the wire rope. This may lead to rider injuries.

Other variations of crash barriers are available, such as rigid and semi-rigid crash barriers. Rigid and semi-rigid crash barriers may be safer for motorcycle users as they can have a higher surface area which allows a motorcycle rider to slide along the barrier, instead of a high pressure point being created like in a wire crash barrier. However, rigid and semi-rigid crash barriers may be more expensive to install and manufacture compared to flexible crash barriers. Rigid and semi-rigid crash barriers may have the benefit of redirecting vehicles quicker, for example, if there is a cliff behind the barrier then it is not desired for the crash barrier to deflect over the cliff.

A person skilled in the art of crash barriers will be aware that semi-rigid or rigid crash barriers can reduce the injury level to motorcyclists, however, rigid solutions are not as cost-effective as flexible tensioned crash barriers. Semi-rigid or rigid crash barriers may not always be a viable option for some roads.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

For the purposes of this specification, the term "plastic" shall be construed to mean a general term for a wide range of synthetic or semisynthetic polymerization products, and generally consisting of a hydrocarbon-based polymer.

It is an object of the present invention to provide a flexible tensioned crash barrier which overcomes or at least partially ameliorates some of the above mentioned disadvantages or which at least provides the public with a useful choice.

STATEMENTS OF INVENTION

Accordingly, in a first aspect the present invention relates to a road crash barrier configured for deflecting errant vehicles, the barrier comprising at least one elongate tensioned flexible strap comprising a planar face facing the road in use.

In one embodiment, the strap's elongate direction extends parallel the road, or lane of a road, in use.

In one embodiment, the planar face has a normal direction facing the road.

In one embodiment, the planar face is perpendicular a surface of the road.

In one embodiment, the planar face is vertical.

In one embodiment, the strap is in at least 20 kN of tension in use.

In one embodiment, the strap is tensioned to over 40 kN in use.

In one embodiment, the strap is tensioned to over 200 kN in use.

In one embodiment, the strap is configured to be tensioned to between 200 kN and 400 kN.

In one embodiment, the planar face comprises a surface that is relatively smooth, and/or continuous along the length of the strap.

In one embodiment, the strap is flat.

In one embodiment, the strap is composed of two distinct straps sandwiched together.

In one embodiment, the strap has a generally rectangular cross section perpendicular its elongate direction.

In one embodiment, the strap in cross section is perpendicular its elongate direction and has a height far greater than its thickness.

In one embodiment, the strap, and therefore the planar face, has a height between 30 mm and 500 mm.

In one embodiment, the strap, and therefore the planar face, has a height between 30 mm and 300 mm.

In one embodiment, the strap, and therefore the planar face, has a height between 40 mm and 100 mm.

In one embodiment, the strap has a thickness of between 3 mm and 10 mm.

In one embodiment, the strap has a thickness of 4 mm.

In one embodiment, the strap has a tensile strength of at least 400 MPa.

In one embodiment, the strap has a tensile strength of at least 800 MPa.

In one embodiment, the strap has an E value between of 40 GPa and 210 GPa.

In one embodiment, the strap is relatively flexible and pliable, and/or has low stiffness.

In one embodiment, the strap comprises of one or more selected from; plastics, glass, synthetics, and metals In one embodiment, the strap is composed of one or more selected from; plastics, glass, synthetics, and metals.

In one embodiment, the strap is composed of steel.

In one embodiment, the steel has a yield strength greater than 300 MPa, greater than 400 MPa. or greater than 500 MPa.

In one embodiment, the steel allows an elongation greater than 9%.

In one embodiment, the strap is coated, and/or the strap is coated in a plastics material.

In one embodiment, the strap is composed of a fibre based composite.

In one embodiment, the strap is composed of at least fibreglass.

In one embodiment, the strap is composed of at least aramids.

In one embodiment, the strap is composed of a composite material.

In one embodiment, the strap is composed of pultruded fibreglass.

In one embodiment, the barrier comprises multiple straps.

In one embodiment, the barrier comprises both composite and metal straps.

In one embodiment, the multiple straps are tensioned to a combined tension of over 100 kN in use.

In one embodiment, the multiple straps are tensioned to a combined tension of over 200 kN in use.

In one embodiment, the barrier comprises a supporting arrangement configured to support the strap at a height above the ground in use.

In one embodiment, the supporting arrangement, or a portion thereof, is configured to release from the strap during or after impact from an errant vehicle and/or rider.

In one embodiment, the supporting arrangement is a rigid, semi-rigid, or deformable barrier.

In one embodiment, the supporting arrangement is an upright.

In one embodiment, the supporting arrangement is a plurality of uprights.

In one embodiment, the supporting arrangement comprises a plurality of deformable and/or collapsible uprights.

In one embodiment, the supporting arrangement is configured to bend, deflect, crumple, break or otherwise move when impacted by a vehicle or rider.

In one embodiment, the supporting arrangement comprises a mount to mount the strap to the upright.

In one embodiment, the mount is configured to releasably disconnect from the upright, and/or releasably disconnect from the strap.

In one embodiment, the uprights support the strap above the ground.

In one embodiment, the mount comprises a retainer.

In one embodiment, the retainer retains the straps or straps to the mount.

In one embodiment, the mount and retainer are releasably engaged with each other via a retainer connection.

In one embodiment, the retainer connection is configured to disconnect when the supporting arrangement is impacted by a vehicle or rider.

In one embodiment, upon disconnection the retainer connection is configured to release the retainer from the mount.

In one embodiment, the release of the retainer from the mount frees the retained straps from the mount.

In one embodiment, the retainer connection is a frangible, snap, or barb type configuration.

In one embodiment, the retainer connection is re-connectable after disconnection.

In one embodiment, the retainer connection comprises a plug.

In one embodiment, the plug is composed of polymer material.

In one embodiment, the plug is composed of a fibre reinforced of polymer material.

In one embodiment, the retainer retains the straps within the retainer, and/or to the adjacent straps, after disconnection.

In one embodiment, the mount and upright are engaged to each via a sliding mount connection.

In one embodiment, the mount connection comprises a socket on the mount configured to receive the upright.

In one embodiment, the mount connection is configured to allow the upright to slide out of the mount, or the mount can slide off the upright, upon impact by a vehicle or rider.

In one embodiment, the supporting arrangement comprises a ground anchor.

In one embodiment, the upright is configured to releasably engage to one or more of the ground anchor and the mount.

In one embodiment, the supporting arrangement comprises an engineered weakness or connection between the ground anchor and the upright.

In one embodiment, the ground anchor comprises a ground engaging screw.

In one embodiment, the strap is tensioned between two end anchors as described in the fifth and sixth embodiment.

In one embodiment, the crash barrier does not utilise brakes, wheels, or pay-out spools.

In one embodiment, the length of straps in a system are between 20 m and 2 km.

In a second aspect the present invention relates to a roadside crash barrier configured for deflecting errant vehicles and road users, the barrier comprising one or more flexible straps with a major planar face configured to face a road in use, and a supporting arrangement configured to extend from the ground in use, to removably retain the one or more straps at a height above the ground.

In one embodiment, the straps are removed from retainment during deflection.

In a third aspect the present invention relates to a roadside crash barrier configured for deflecting errant vehicles and road users of a carriageway, the barrier comprising one or more flexible straps with a major planar face having a normal direction generally facing the carriageway, and a supporting arrangement configured to extend from the ground in use, to removably retain the one or more straps at a height above the ground.

In one embodiment, the straps are removed from retainment during impact from said errant vehicle or road user of the carriageway In a fourth aspect the present invention relates to a roadside crash barrier comprising at least one flexible strap under tension comprising a vertical planar face.

In a fifth aspect the present invention relates to an end anchor for an elongate flexible tensioned roadside crash barrier, where the end anchor comprises two or more supporting arrangements configured to be secured to the ground, where one supporting arrangement is nearer more or at a terminal end of the end anchor; at least one supporting arrangement comprising one or more attachment points for one or more tensioned flexible members to extend in a first direction away from the terminal end towards the crash barrier, a stiff tensile member removably engaged at one end to a lower region of at least one supporting arrangement and also removably engaged at its opposite end to an upper region of a connected supporting arrangement spaced apart in the first direction In one embodiment, the supporting arrangements are secured to the ground via ground screws or piles.

Alternatively, the uprights are secured to the ground via a ground plate.

In one embodiment, the tensile member is under tension when the flexible member(s) are under tension.

In one embodiment, the tensile member comprises a thread at each end configured to receive a nut.

In one embodiment, the supporting arrangements are configured to pivot and/or deform at a region of engineered weakness below the lower region.

In one embodiment, the pivoting and/or deformation of the supporting arrangement allows the tensile member to be released or partially released from the said pivoting and/or deformed supporting arrangement at the lower region.

In one embodiment, the pivoting and/or deformation of the supporting arrangement allows the tensile member to be released or partially released from the connected supporting arrangement.

In one embodiment, the tensile member has a lower end removably engaged to the lower region, and an upper end removably engaged to the upper region of a connected supporting arrangement.

In one embodiment, the lower end is removably engageable to the supporting arrangement via a lower mount comprising an upwardly facing slot that receives the lower end.

In one embodiment, the upper end is removably engageable to the connected supporting arrangement via an upper mount comprising a downwardly facing slot that receives the upper end.

In one embodiment, as the supporting arrangement pivots and/or deforms the lower mount releases the lower end.

In one embodiment, the upper mount on the connected supporting arrangement is configured to release the upper end as the lower end is released from the lower mount.

In one embodiment, the pivoting and/or deformation of the supporting arrangement releases tension in the tensile member.

In one embodiment, the pivoting and/or deformation of the supporting arrangement causes release of either or both ends of the tensile member.

In one embodiment, the end anchor comprises multiple supporting arrangements in a spaced apart row each with respective tensile member adjoining them from a lower region to an upper region.

In one embodiment, the supporting arrangements are adjoined to the directly adjacent supporting arrangement via the tensile member.

Alternatively, the supporting arrangements are adjoined to an supporting arrangement more than one supporting arrangement away via the tensile member.

In one embodiment, all the supporting arrangements of the end anchor are identical In one embodiment, all the supporting arrangements of the end anchor are connected to the flexible members.

In one embodiment, all the supporting arrangements of the end anchor are connected to the flexible members.

In one embodiment, the tensile member(s) transfer a portion of a tensile load of the tensioned flexible members from the upper region(s) to the lower region(s) of the adjoined supporting arrangement(s).

In one embodiment, the crash barrier comprises one or more tensioned strap(s), tensioned wire(s), or a combination of both.

In one embodiment, the end anchor comprises three, four, five, six, seven, or more supporting arrangements.

In one embodiment, the tensile member acts in tension in operation to create a truss type arrangement between the supporting arrangements of the end anchor.

In one embodiment, upper region is higher than the lower region.

In one embodiment, the upper region is generally the height of the flexible member attachment points.

In one embodiment, the lower region is generally above or close to ground level in operation.

In one embodiment, the tensile member is a threaded rod.

In one embodiment, the tensile member is between 5 and 30 mm, and preferably 16 mm in diameter.

In one embodiment, the tensile member is held within the upper and lower mounts via the nuts on the end of the threaded rod, that when tightened create tension in the tensile member and impart force and friction on the mounts.

In one embodiment, the pivoting or deformation of an supporting arrangement moves the lower or upper mount closer to the adjoined upper or lower mount respectively, thus allowing the tensile member to disengage from one or both upper and lower mounts.

In one embodiment, the flexible member is one of the straps as described above in the first to fourth aspects.

In a sixth aspect the present invention relates to an end anchor for roadside crash barrier comprising tensioned flexible members, where the end anchor is located at a terminal end of the barrier which extends away from the terminal end in a first direction, the end anchor comprising a stiff tensile member adjoining at least two adjacent supporting arrangements, the tensile member configured to a) direct at least part of the tension of the flexible members from an upper region of a supporting arrangement to a lower region of an adjacent adjoined supporting arrangement, and b) release from engagement of either or both the upper region and lower region when either supporting arrangement is impacted by a vehicle or object coming from the first direction or a second direction opposite the first direction.

In one embodiment, the end anchor comprises a plurality of supporting arrangements.

In one embodiment, each supporting arrangement comprises one or more attachment points for the tensioned flexible members to extend between the two (or more) supporting arrangements.

In one embodiment, at a lower region of at least one supporting arrangement is attached a tensile member that extends upwards to an upper region of a supporting arrangement in the first direction.

In one embodiment, the supporting arrangements are configured to pivot and/or deform at a region of engineered weakness below the lower region, so that the upper region of the same supporting arrangement moves relative the region of engineered weakness.

In one embodiment, the elongate flexible barrier comprises one or more tensioned strap(s), tensioned wire(s), or a combination of both.

In one embodiment, the end anchor comprises three, four, five, six, seven, or more supporting arrangements.

In one embodiment, the sixth aspect comprises one or more of the embodiments of the fifth aspect.

In a seventh aspect the present invention relates to end anchor for anchoring the ends of flexible members of a road barrier, the end anchor having a road barrier end closer the road barrier, and a terminal end further away from the road barrier that is able to face an oncoming vehicle, the end anchor comprising a. a collapsible support configured to receive the flexible members at the road barrier end, the support post configured to pivot about its base towards the road barrier end, b. a trigger nearer more the terminal end configured to pivot about its base towards the road barrier end when engaged by a vehicle c. a support unit configured to be affixed securely to the ground, the support unit engaged with the base of both the support and the trigger, as well receiving and restraining the ends of the flexible members, d. a brace pivotably engaged on the road barrier side of both the support and support unit, the brace bracing the support so the support can maintain the tension of the flexible members, the brace comprising a pivotable section intermediate its ends allowing the brace to hinge towards the road barrier, e. an actuator extending between, and pivotally engaged to, the trigger and brace, wherein the trigger is configured to pivot at or towards its base when engaged by said vehicle so as to actuate the actuator, the actuator subsequently causing the brace to hinge and remove its bracing capabilities to the support to allow the support to collapse or partially collapse, thus in turn releasing tension in the flexible members.

In one embodiment, the end anchor is configured to prevent vehicle rollover should said vehicle impact the end anchor from the terminal end.

In one embodiment, the end anchor is configured to prevent vehicle rollover should said vehicle impact the end anchor from the terminal end, by allowing the flexible members to lose partial tension or all tension.

In one embodiment, the brace acts as an over-centre mechanism.

In one embodiment, the actuator is configured to push the pivotable section over centre so the brace cannot act in compression to support the support post.

In one embodiment, the brace has an upper section and lower section pivotably joined together at the pivotable section.

In one embodiment, the actuator is removably engaged with the brace.

In one embodiment, the actuator is removably engaged with upper section.

In one embodiment, the actuator is removably engaged via a slot and complementary pin system, and/or the actuator and brace can completely disengage from each other to allow the brace to fully hinge and the support to collapse.

In one embodiment, the actuator is removably engaged to the upper section.

In one embodiment, the upper section comprises a lever that extends below the pivotable section.

In one embodiment, the actuator is removably engaged to the lever.

In one embodiment, the flexible members are straps.

In one embodiment, the straps along the road barrier have their major face facing the road, and are received by the support with their major face facing upwards.

In one embodiment, the straps are twisted 90 degrees from the road barrier when entering the anchor.

In one embodiment, the trigger comprises an upper region above where the actuator is engaged to, that acts as a rigid lever to engage with said vehicle.

In one embodiment, the end anchor is configured to move between a collapsed condition and an operating condition.

In one embodiment, in the operating condition the flexible members are held at operating height, and operating tension so that road barrier can act at its optimal capacity.

In one embodiment, in the collapsed condition, when the brace is hinged, the flexible members have their tension reduced compared to the tension at optimal capacity.

In one embodiment, in the collapsed condition, when the brace is hinged, the flexible members at the end anchor are lowered.

In one embodiment, in the collapsed condition, when the brace is hinged, the flexible members retain tension so the barrier can operate with limited capacity of said optimal capacity.

In one embodiment, the actuator is over two metres long.

In one embodiment, the end anchor is configured not be damaged or weakened if moved to the collapsed condition, In one embodiment, the end anchor can be moved back from the collapsed condition to the operating condition by actuating the trigger and reengaging (if disengaged) the actuator with the brace.

In an eight aspect the present invention relates to an end anchor for anchoring an end of a road barrier comprising one or more flexible tensioned members, the end anchor having a road barrier end closer the road barrier, and a terminal end further away from the road barrier to face an oncoming vehicle, the end anchor configured to move between an operating condition where the end anchor holds the tensioned member(s) in a first tension; and a collapsed condition where the end anchor releases the tensioned member(s) from the first tension, wherein the end anchor comprises a trigger configured to engage with, and be actuated, to move the end anchor from the operating condition to the collapsed condition.

In one embodiment, in the collapsed condition the tensioned members are lowered closer to or towards the ground than in the operating condition.

In one embodiment, the end anchor is configured not be damaged or weakened if moved to the collapsed condition, and/or the road barrier can be moved back from the collapsed condition to the operating condition by actuating the trigger back to its operating condition.

In one embodiment, a support supports the tensioned members above the ground, and redirects the tensioned members from the road barrier to a support unit near the ground, the support unit holding the tension in the tensioned members.

In one embodiment, the trigger actuates a brace that in the operating condition braces the support, and in the collapsed condition does not brace the support.

In one embodiment, when the road barrier is moved from the collapsed condition to the operating condition the brace resets itself to a bracing condition where it can again act to brace the support in supporting the tension of the tensioned members in the operating condition.

In one embodiment, the brace utilises an over centre mechanism.

In one embodiment, the trigger is located at the terminal end.

In one embodiment, in the operating condition the support is erect and holds the tensioned members at their operating height, and in the collapsed condition the tensioned members are lowered below the operating height.

In one embodiment, the trigger is actuated by said oncoming vehicle.

In one embodiment, the brace is actuated not via the trigger, but by another means such as a hook, pull rope, pulling member that may be actuated by a user or vehicle.

In one embodiment, the trigger applies force directly or indirectly to the brace or support.

In one embodiment, the trigger is configured to directly or indirectly push or pull the brace to collapse the brace.

In one embodiment, the trigger and brace are connected together by an actuating member that acts in compression or tension, the actuating member allows the trigger to push or pull the brace to move the end anchor between the operating and collapsed condition.

In one embodiment, the actuating member is a beam that acts in compression.

In one embodiment, the actuating member is a flexible members that acts in tension.

In one embodiment, the brace is part of the support.

In one embodiment, the end anchor comprises a. a collapsible support configured to receive the flexible members at the road barrier end, the support configured to pivot about its base towards the road barrier end, b. the trigger nearer more the terminal end configured to pivot about its base towards the road barrier end, c. a support unit configured to be affixed securely to the ground, the support unit engaged with the base of both the support and the trigger post, as well receiving and restraining the ends of the flexible members, d. a brace pivotably engaged on the road barrier side of both the support and support unit, the brace bracing the support towards the terminal end so the support can maintain the tension of the flexible members, the brace comprising a pivotable section intermediate its ends allowing the brace to hinge towards the road barrier end, e. a actuators extending between, and pivotally engaged to, the trigger and brace, wherein the trigger is configured to pivot at or towards its base when impacted by said vehicle so as to actuate the actuator that will subsequently cause the brace to hinge and remove its bracing capabilities and thus allow the support to collapse or partially collapse, thus moving the end anchor to its collapsed condition.

Wherein all of the above embodiments of the first aspect may relate to the second, third and fourth aspect.

In a further aspect the present invention may be said to be an end anchor for anchoring an end of a road crash barrier that extends parallel the carriage way of a road and comprising one or more flexible tensioned members that extend parallel the carriageway, the end anchor comprising a road crash barrier end closer the road crash barrier at where the road crash barrier is directly or indirectly connected to the end anchor, and a terminal end away from the road crash barrier end at where the end anchor is anchored directly or indirectly to the ground and to face an oncoming vehicle, the end anchor configured to move between an operating condition where the end anchor holds the tensioned member(s) in a first tension; and a collapsed condition where the end anchor releases the tensioned member(s) from the first tension being less than the first tension, wherein the end anchor comprises a trigger configured to engage with, and be actuated, to move the end anchor or to allow the end anchor move or be moved from the operating condition to the collapsed condition.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification and claims means "consisting at least in part of". When interpreting statements in this specification and claims which include that term, the features, prefaced by that term in each statement, all need to be present but other features can also be present. Related terms such as "comprise" and "comprised" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

The entire disclosures of all applications, patents and publications, cited above and below, if any, are hereby incorporated by reference.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.)

Figure 2:
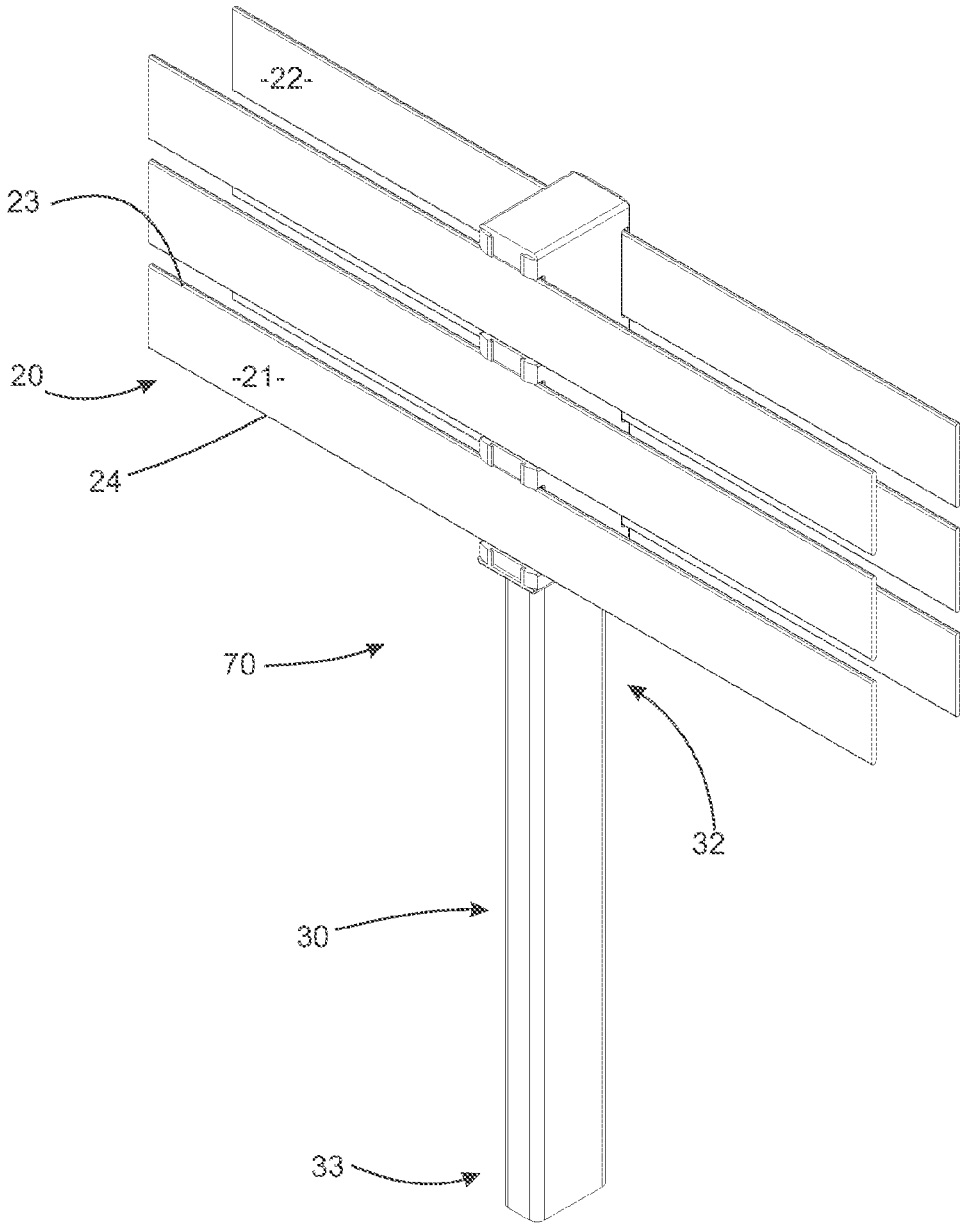
Figure 3:
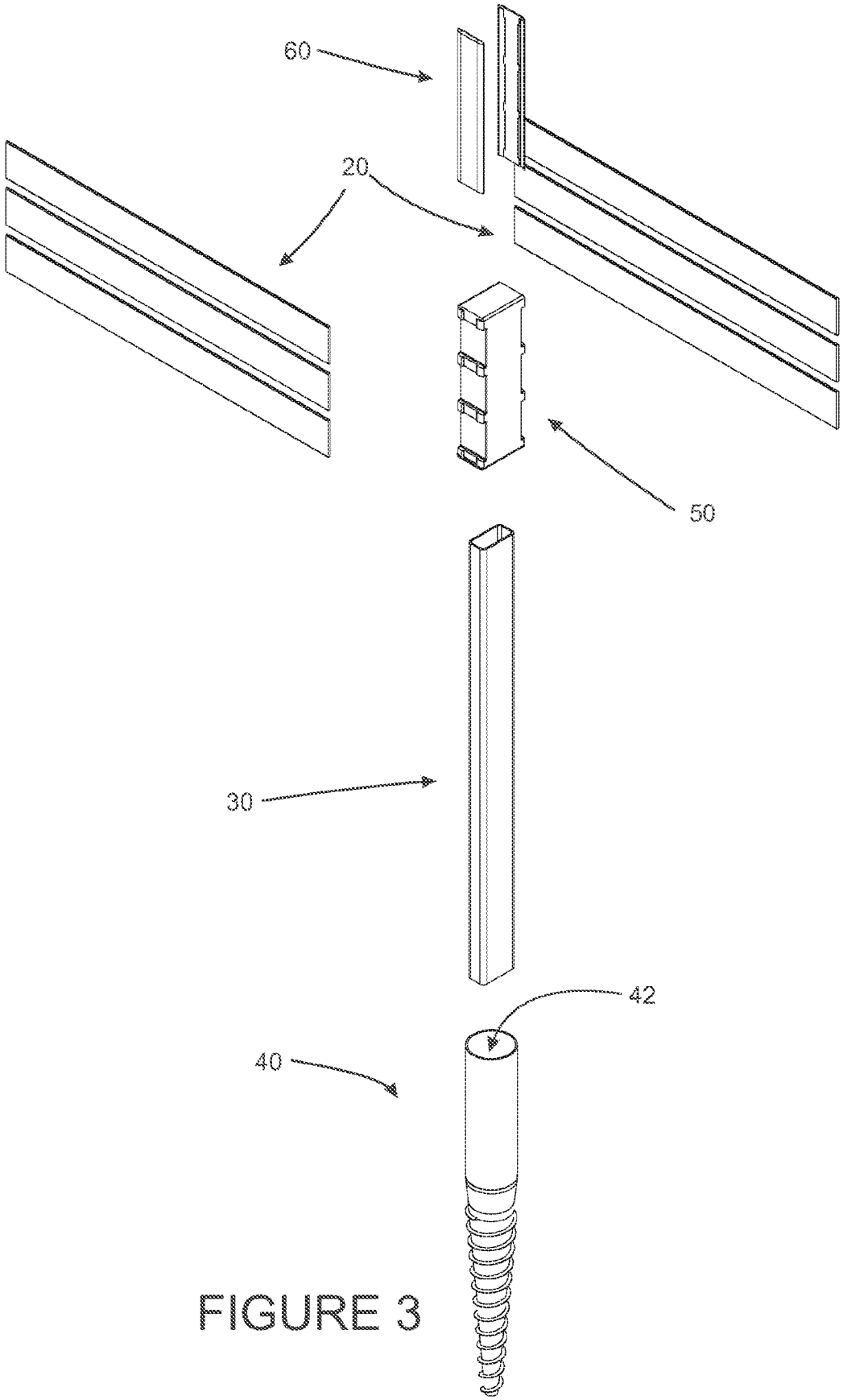
Figure 4:
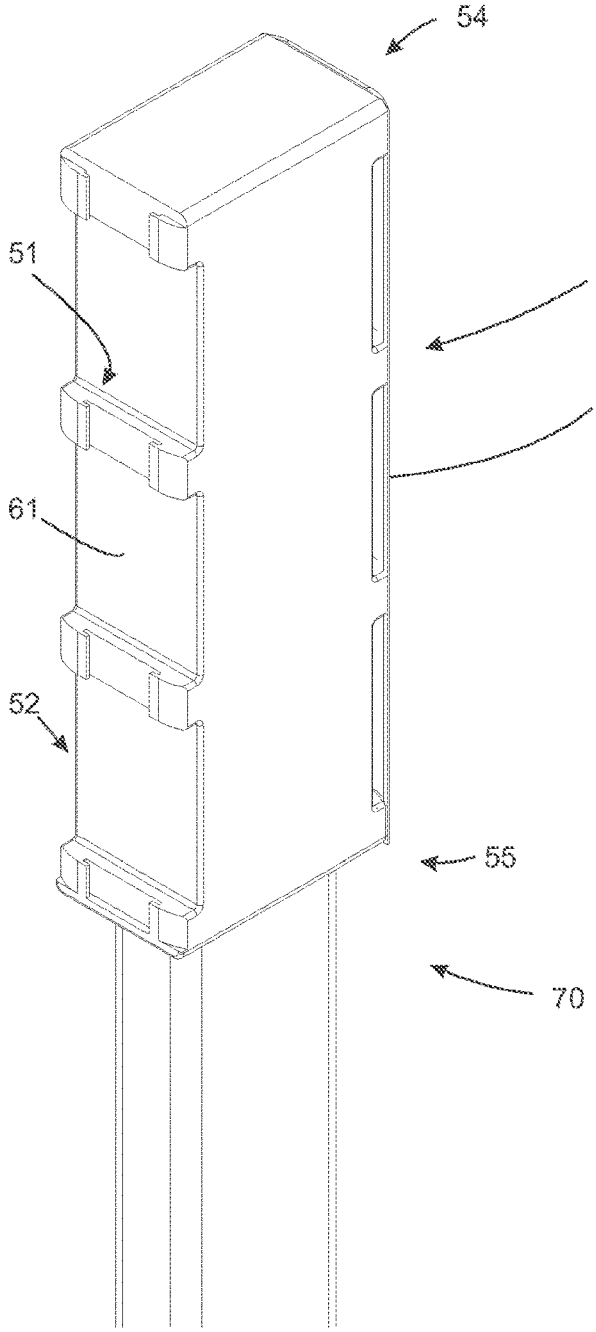
Figure 5:
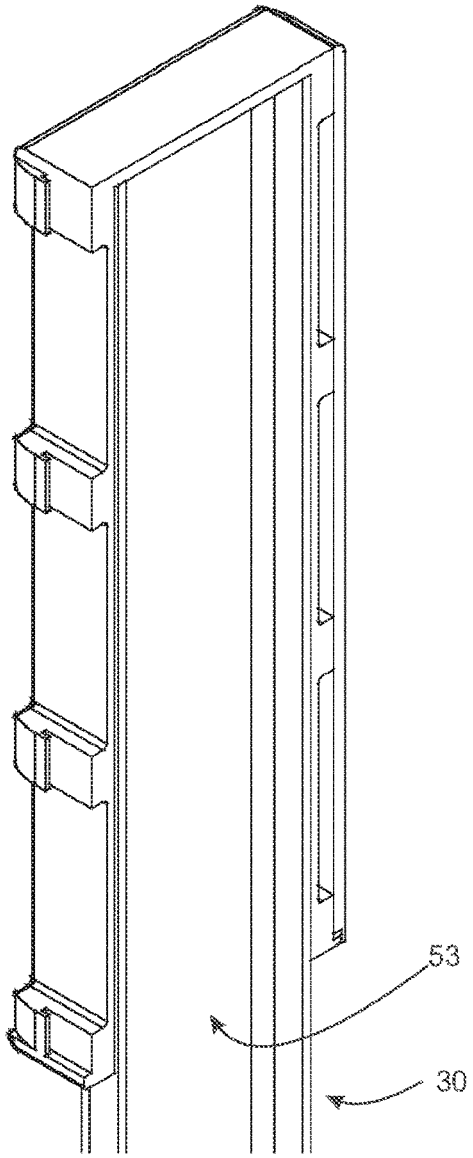
Figure 6:
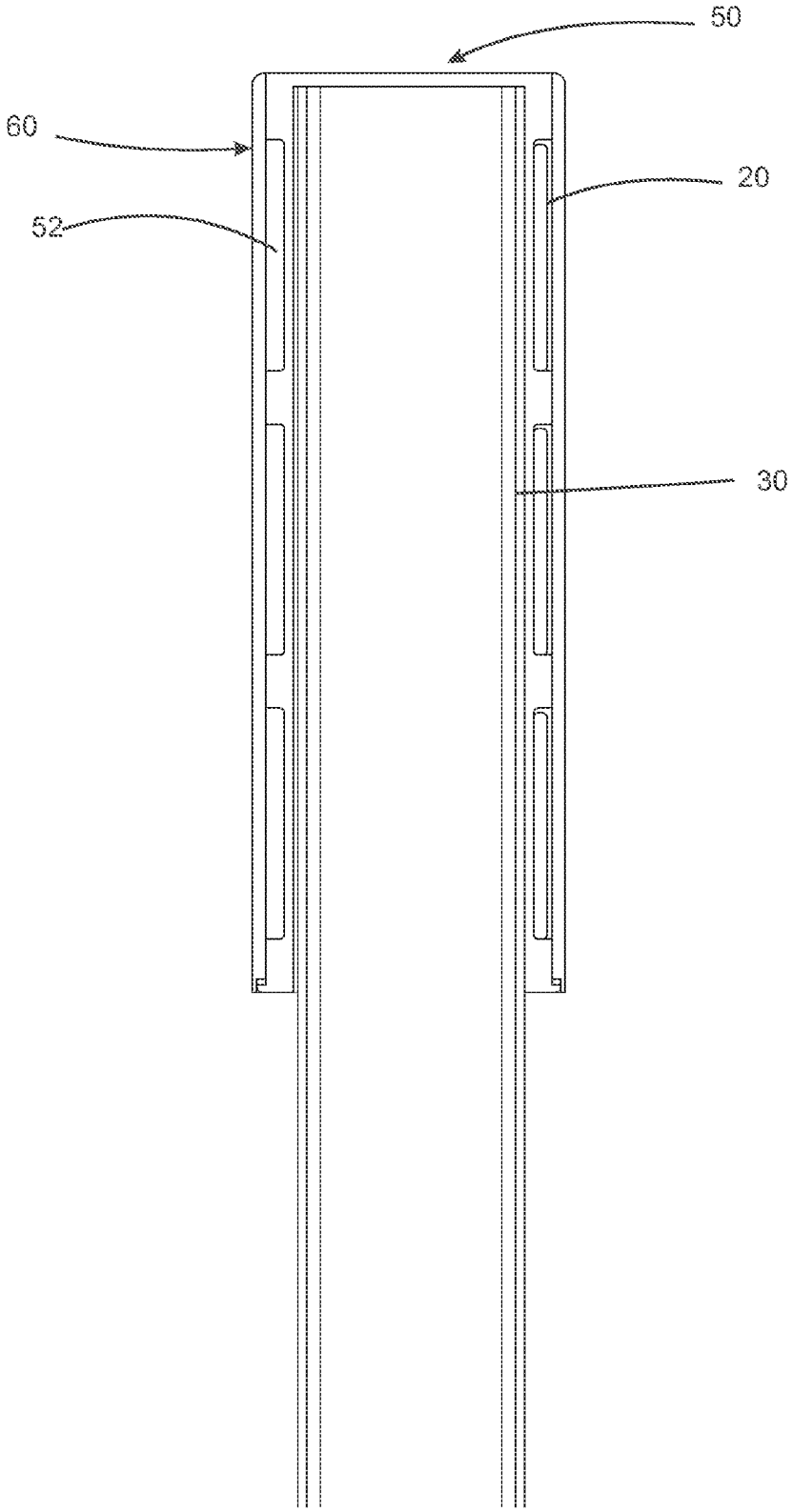
Figure 7:
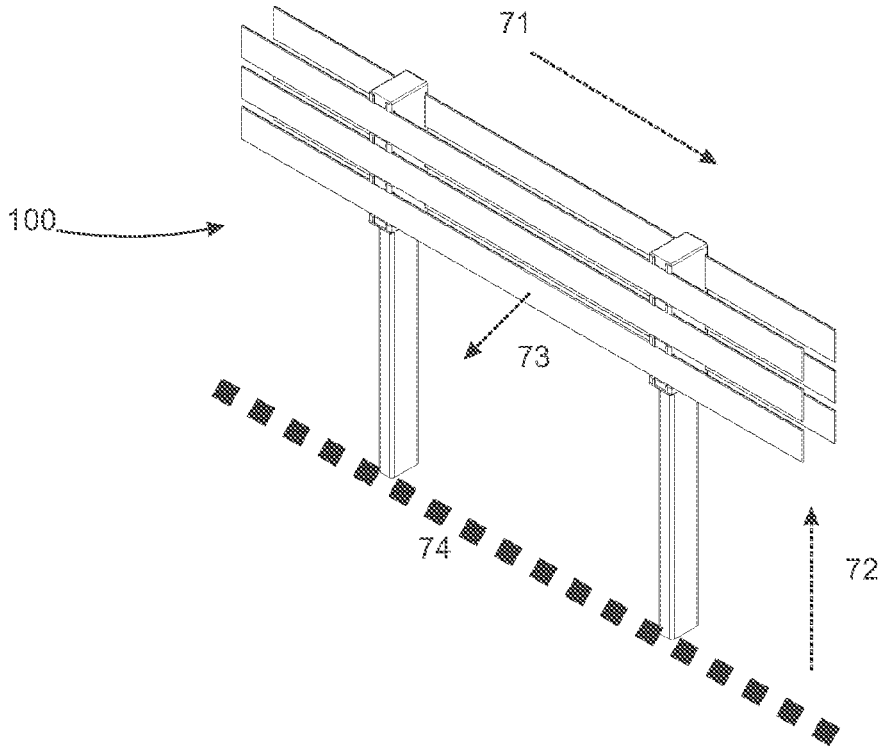
Figure 8:
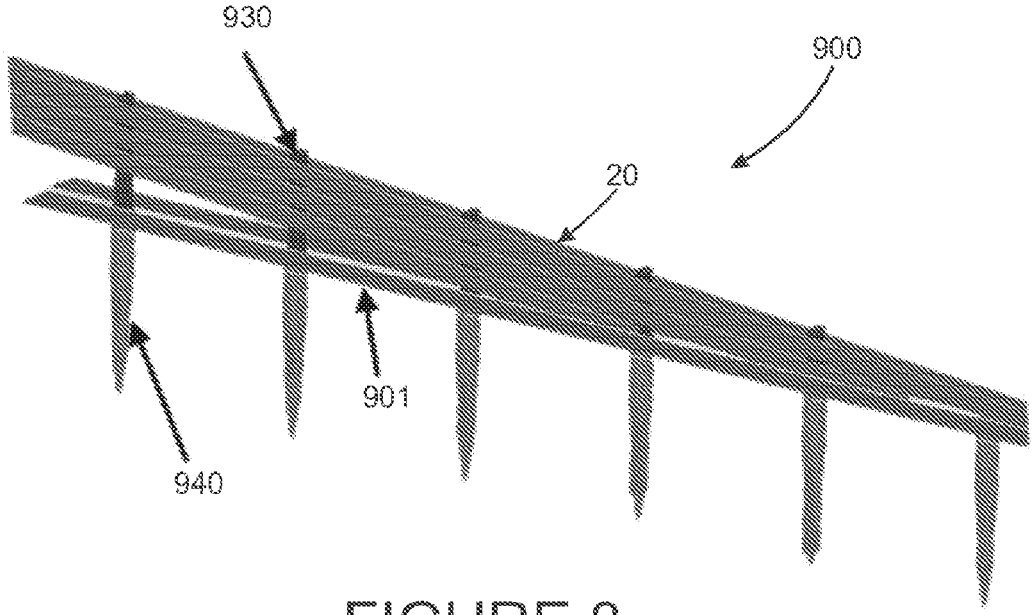
Figure 9:
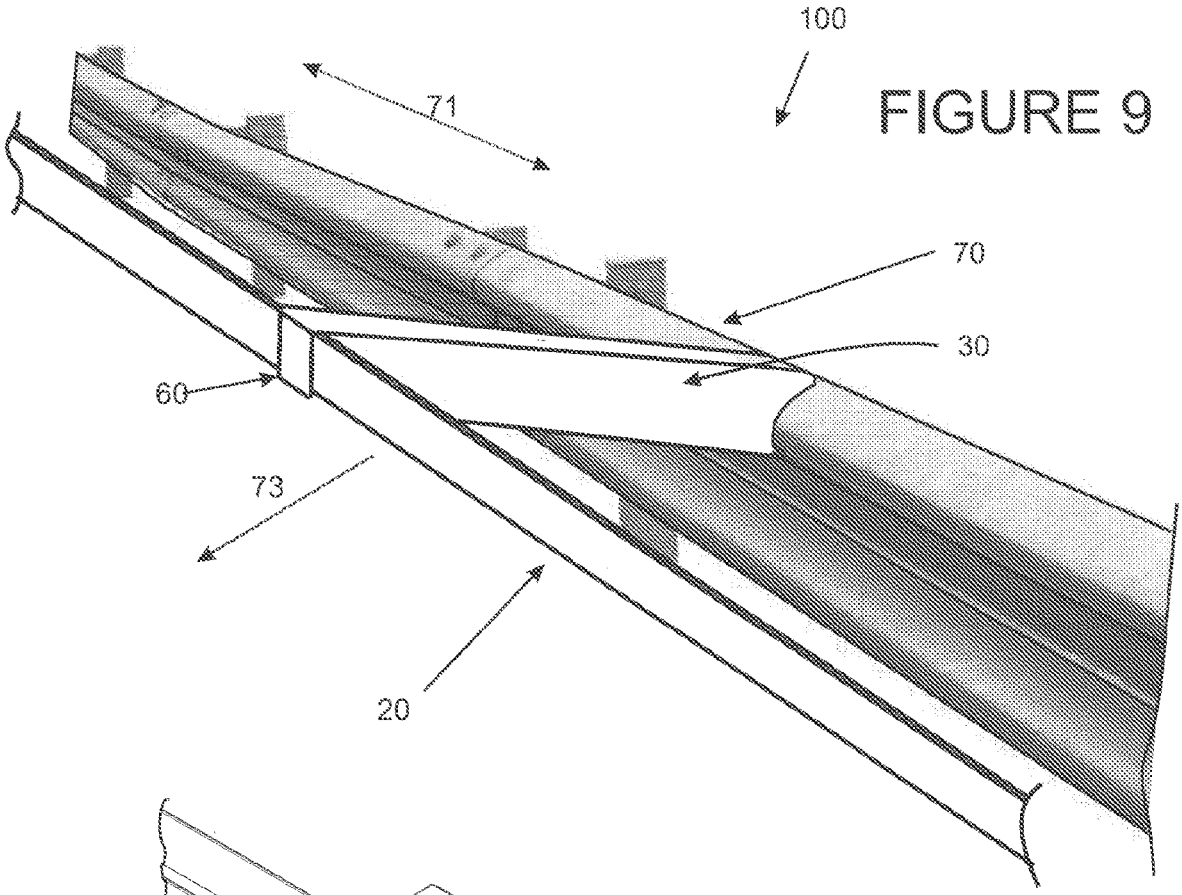
Figure 10:
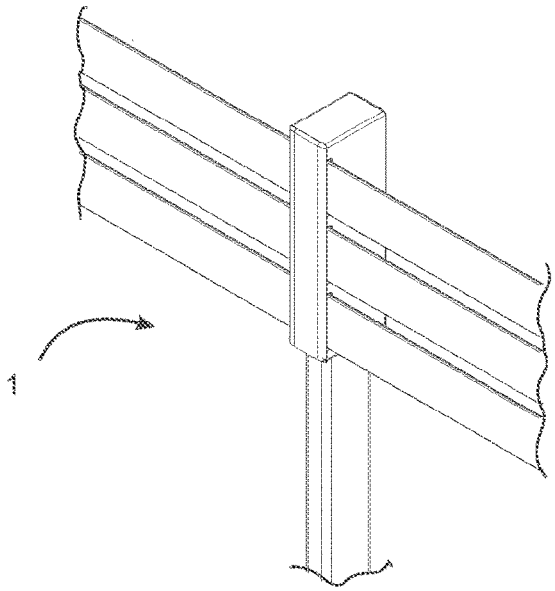
Figure 11:
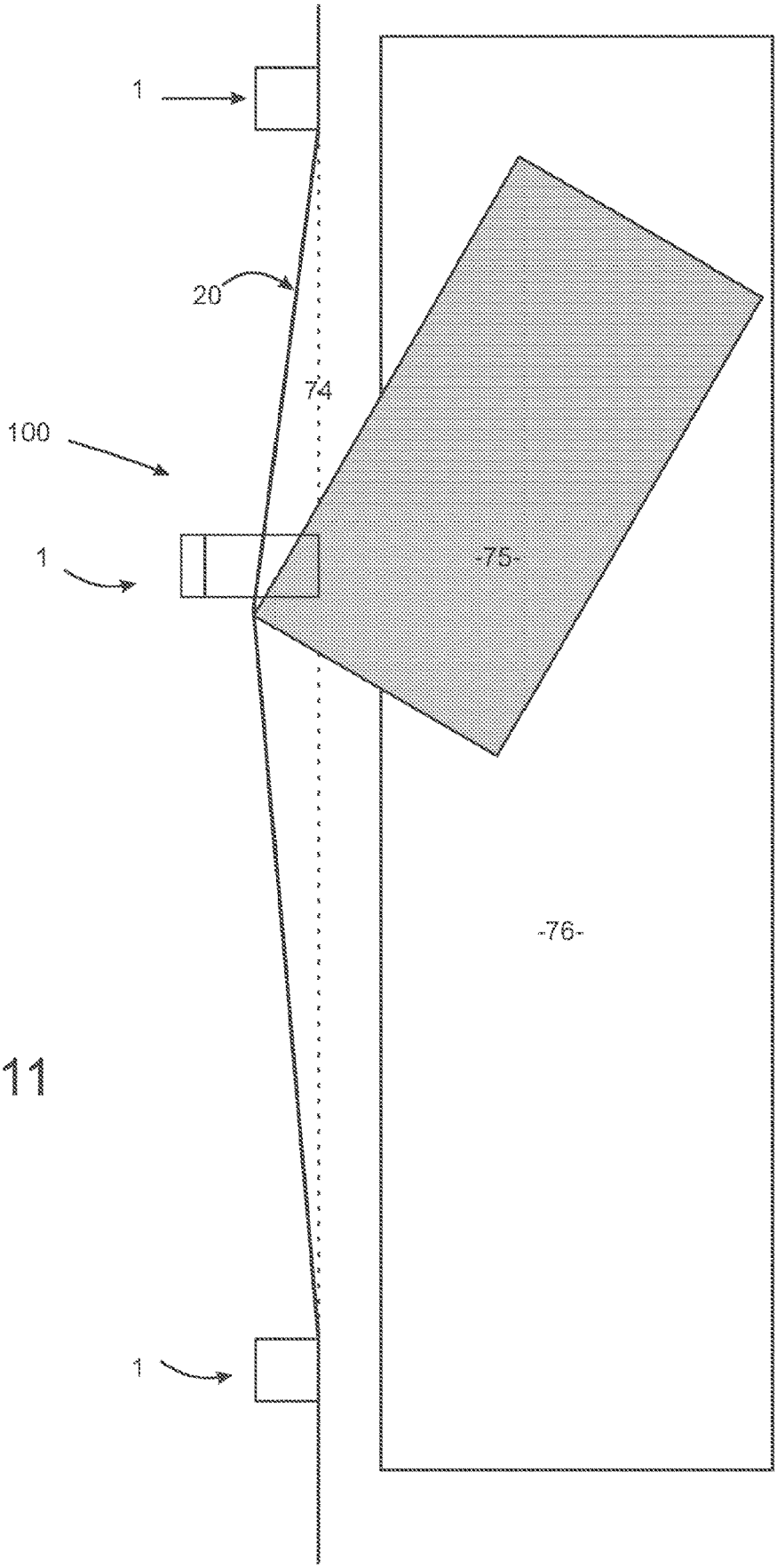
Figure 12:
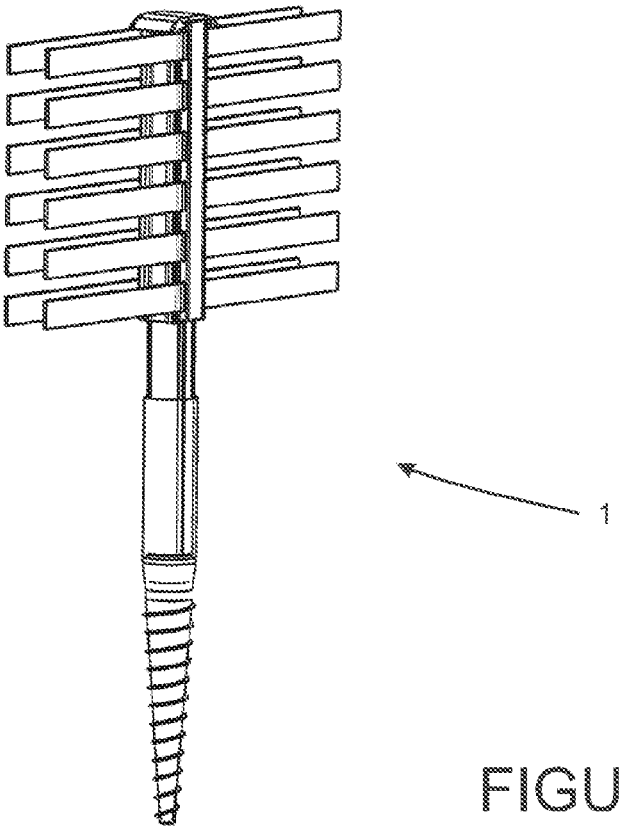
Figure 13:
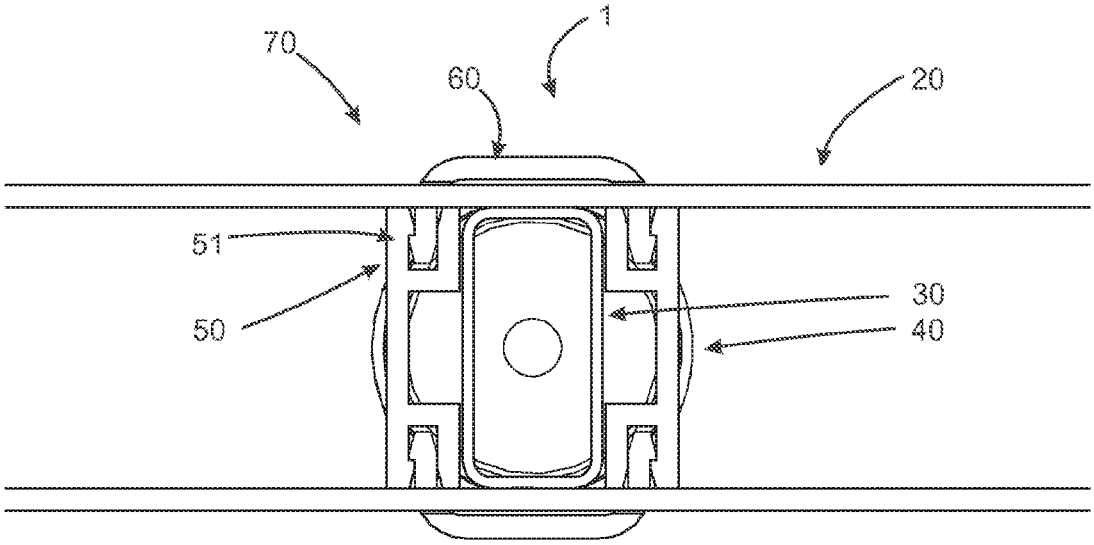
Figure 16:
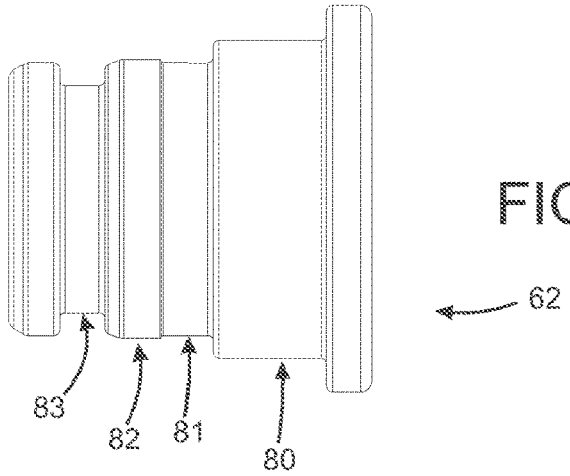
Figure 17:
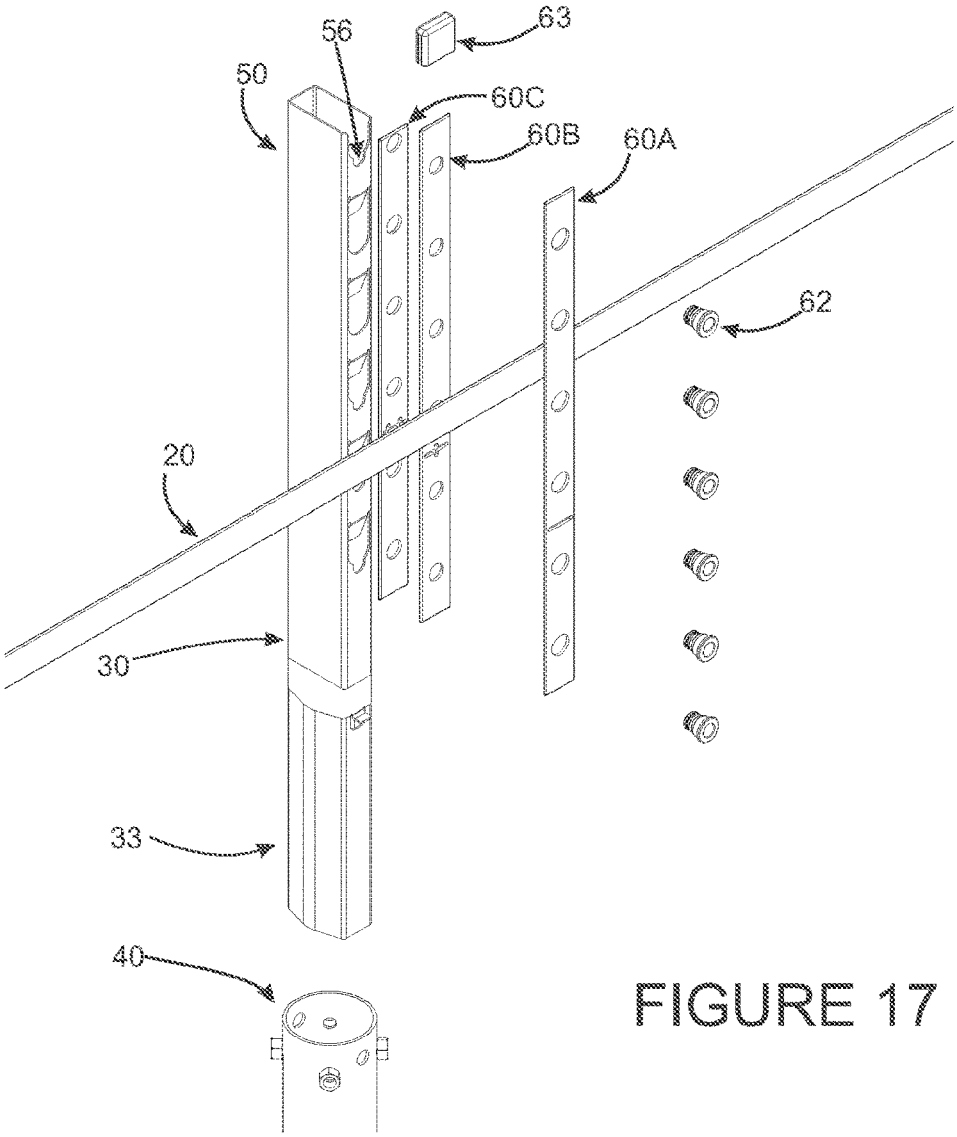

The invention will now be described by way of example only and with reference to the drawings in which:

FIG. 1: shows a front top perspective view of a crash barrier,

FIG. 2: shows a front top perspective view of a crash barrier without the ground anchor, FIG. 3: shows a front top perspective view of a crash barrier exploded into parts, FIG. 4: shows a front top perspective view of the mount, FIG. 5: shows a cross section of FIG. 4, FIG. 6: shows a side view of FIG. 5, FIG. 7: shows a front top perspective view of a crash barrier system, FIG. 8: shows a front top perspective view of an anchor, FIG. 9: shows a front top perspective view of an alternative crash barrier, FIG. 10: shows a front top perspective view of an alternative crash barrier, FIG. 11: shows a top schematic view of a vehicle impacting a crash barrier system, FIG. 12: shows a top front perspective view of an alternative crash barrier, FIG. 13: shows a top cross sectional view of FIG. 12 highlighting the mount and retainer engagement, FIG. 14: shows a front top perspective view of an alternative crash barrier, FIG. 15: shows a side cross-sectional view of FIG. 14 highlighting the mount, plug and retainer engagement, FIG. 16: shows a side view of one of the plugs in FIG. 14, and FIG. 17: shows an exploded view of FIG. 14 highlighting the plugs and retainers.

Figure 18:
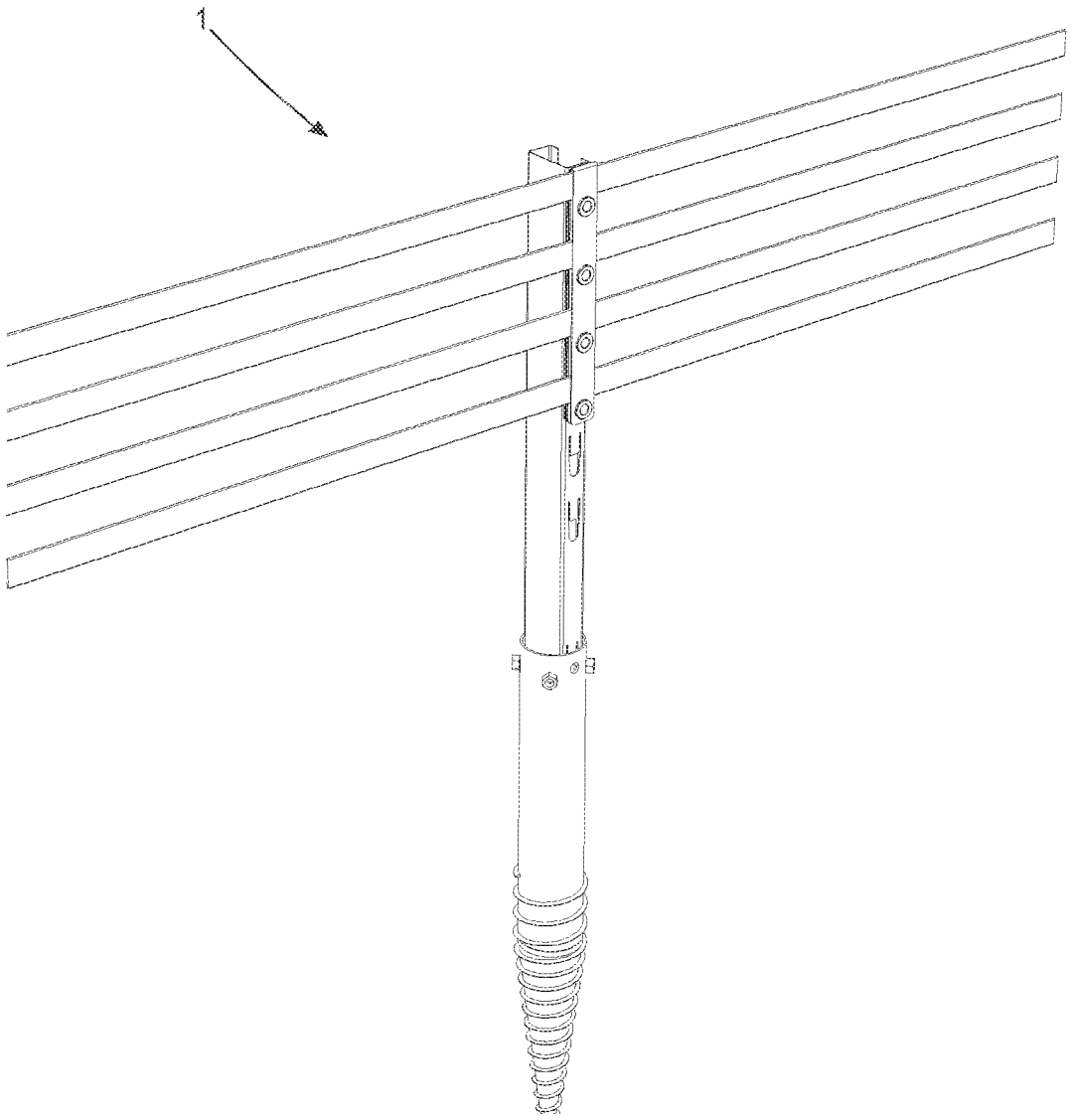
Figure 19:
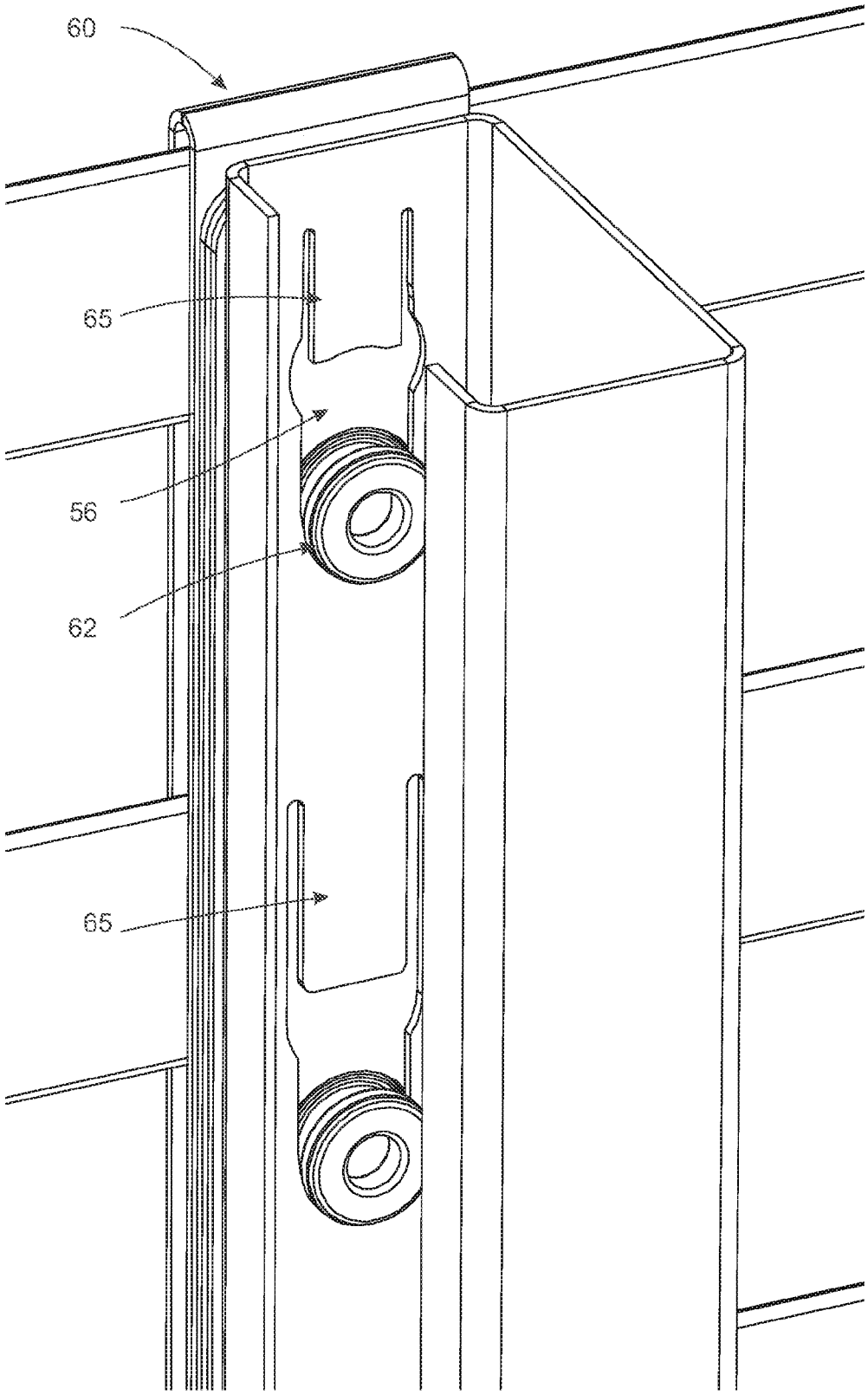

FIG. 18: shows a front top perspective view of a crash barrier with a C post FIG. 19: shows a rear view of FIG. 19.

Figure 20:
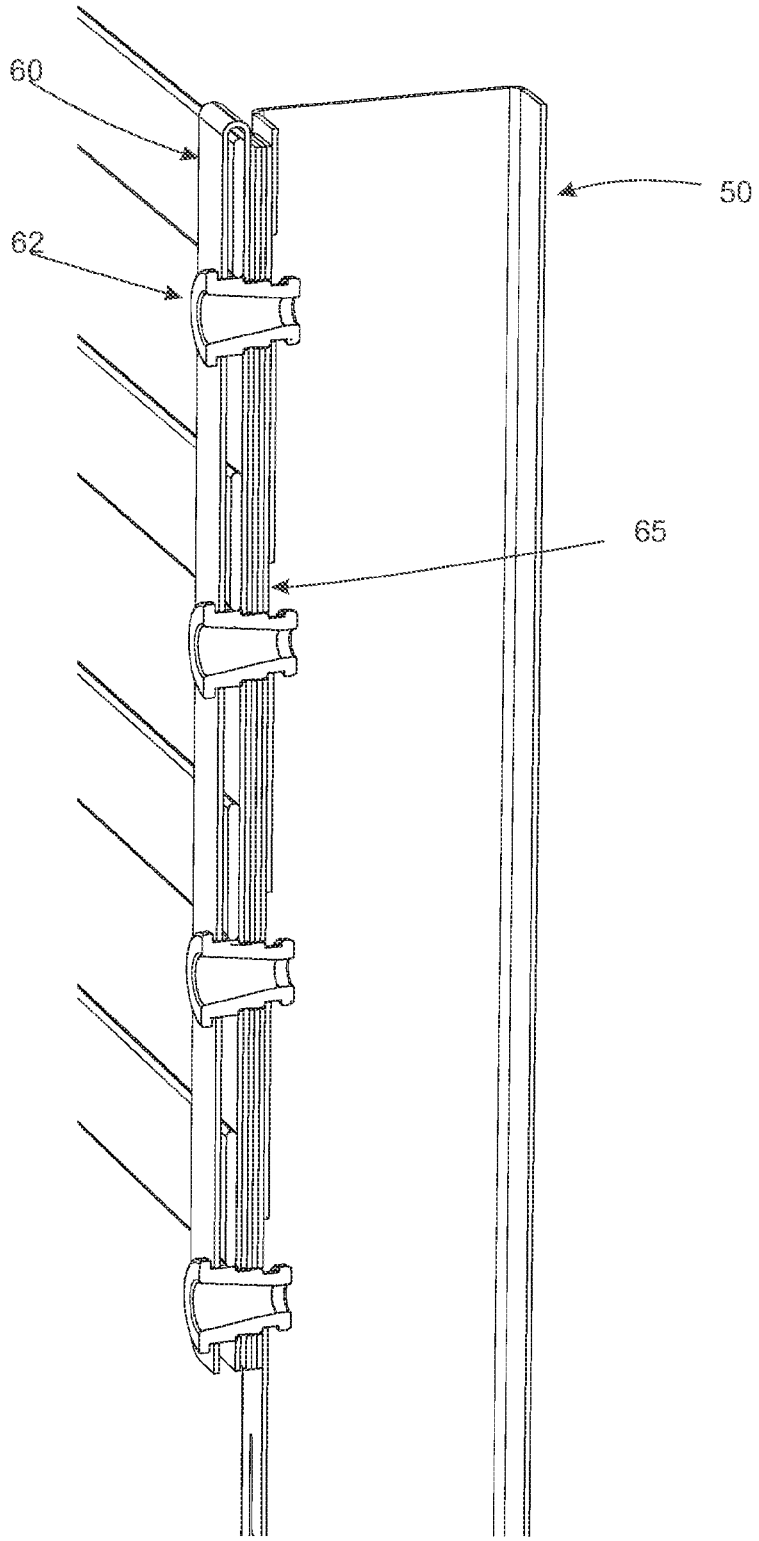

FIG. 20: shows a cross-sectional view of FIG. 19.

Figure 21:
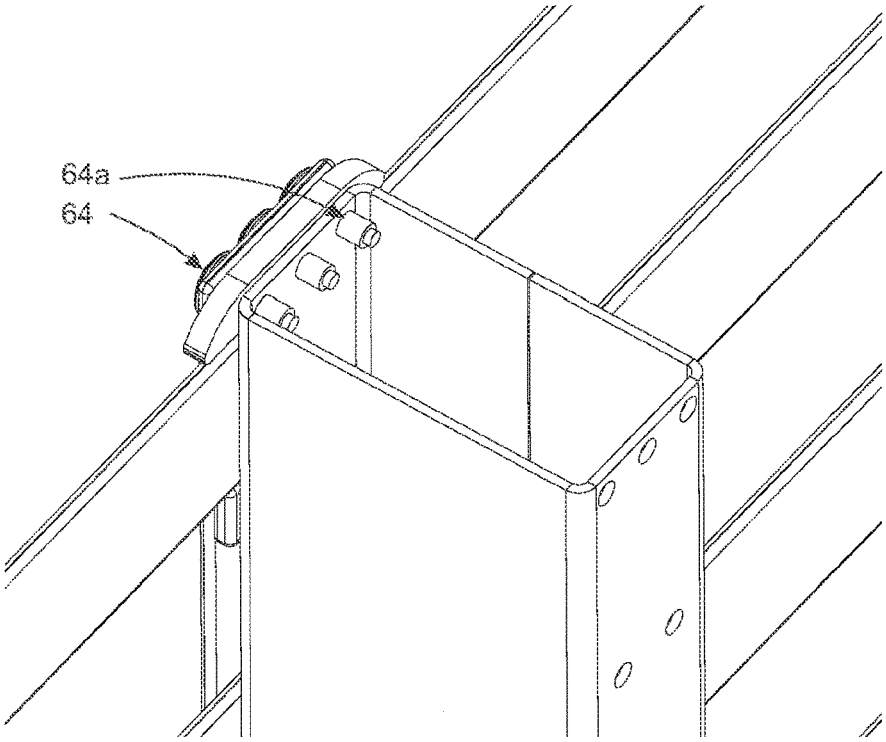

FIG. 21: shows a rear top perspective view of a crash barrier with deformable rivets.

Figure 22:
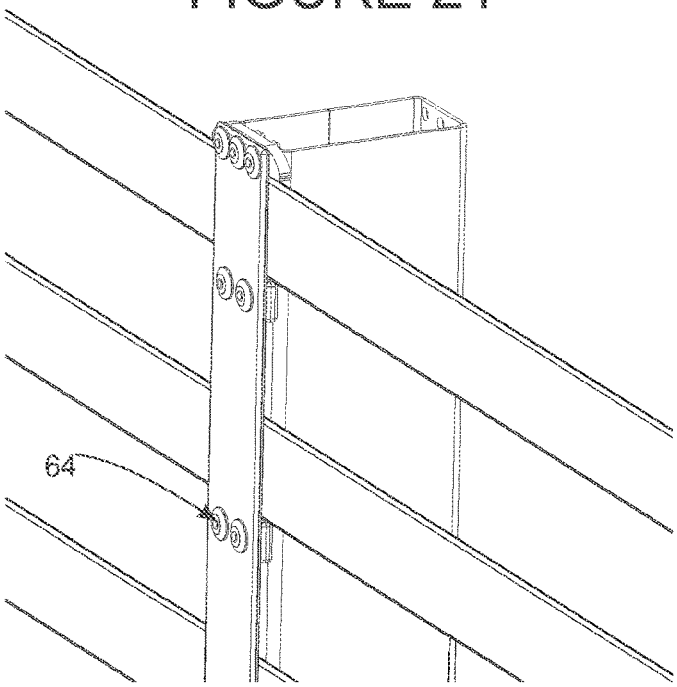

FIG. 22: shows a front top perspective view of FIG. 21.

Figure 23:
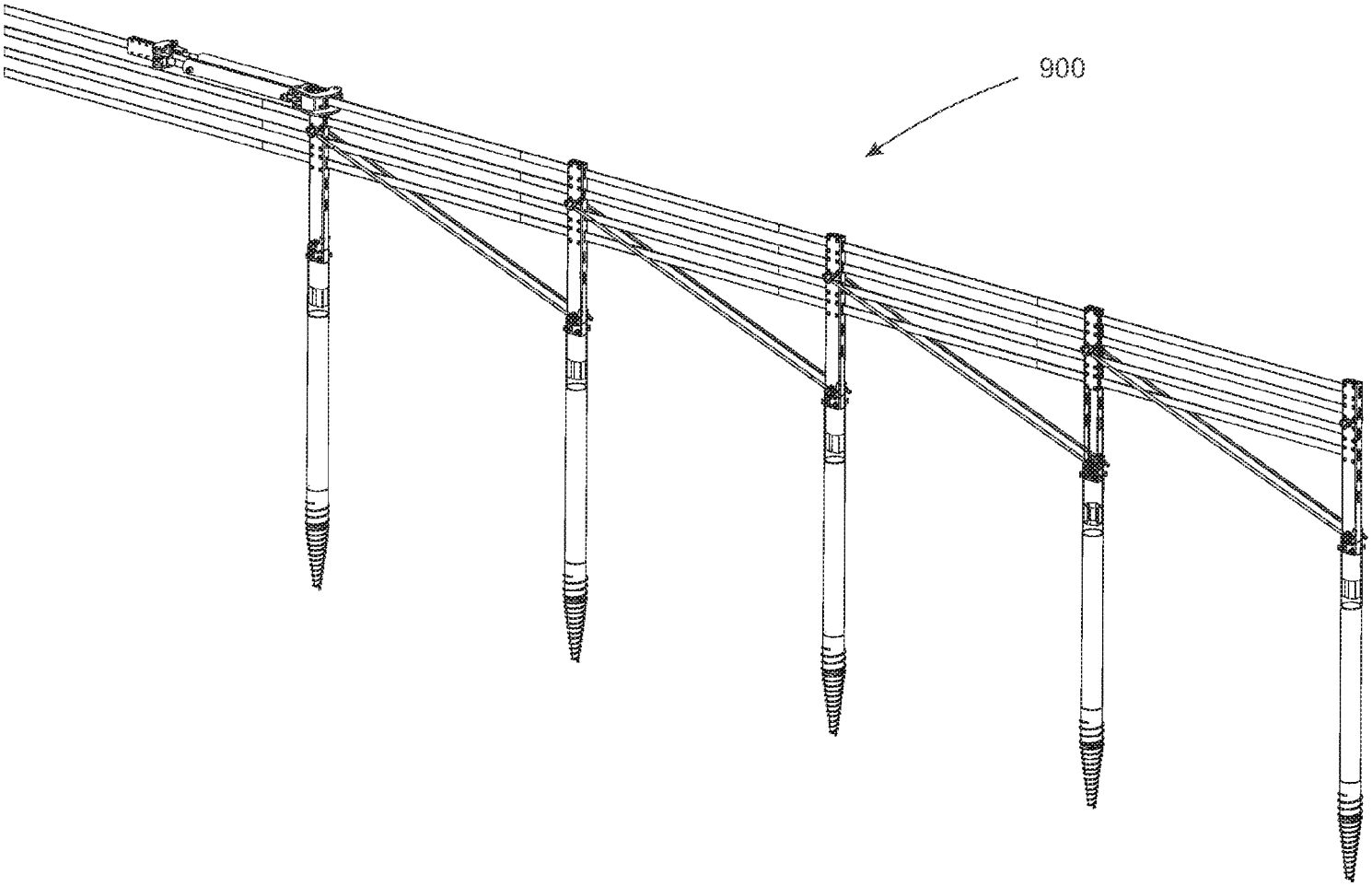

FIG. 23: shows a front top perspective view of a second embodiment of an end anchor in an operational condition.

Figure 24:
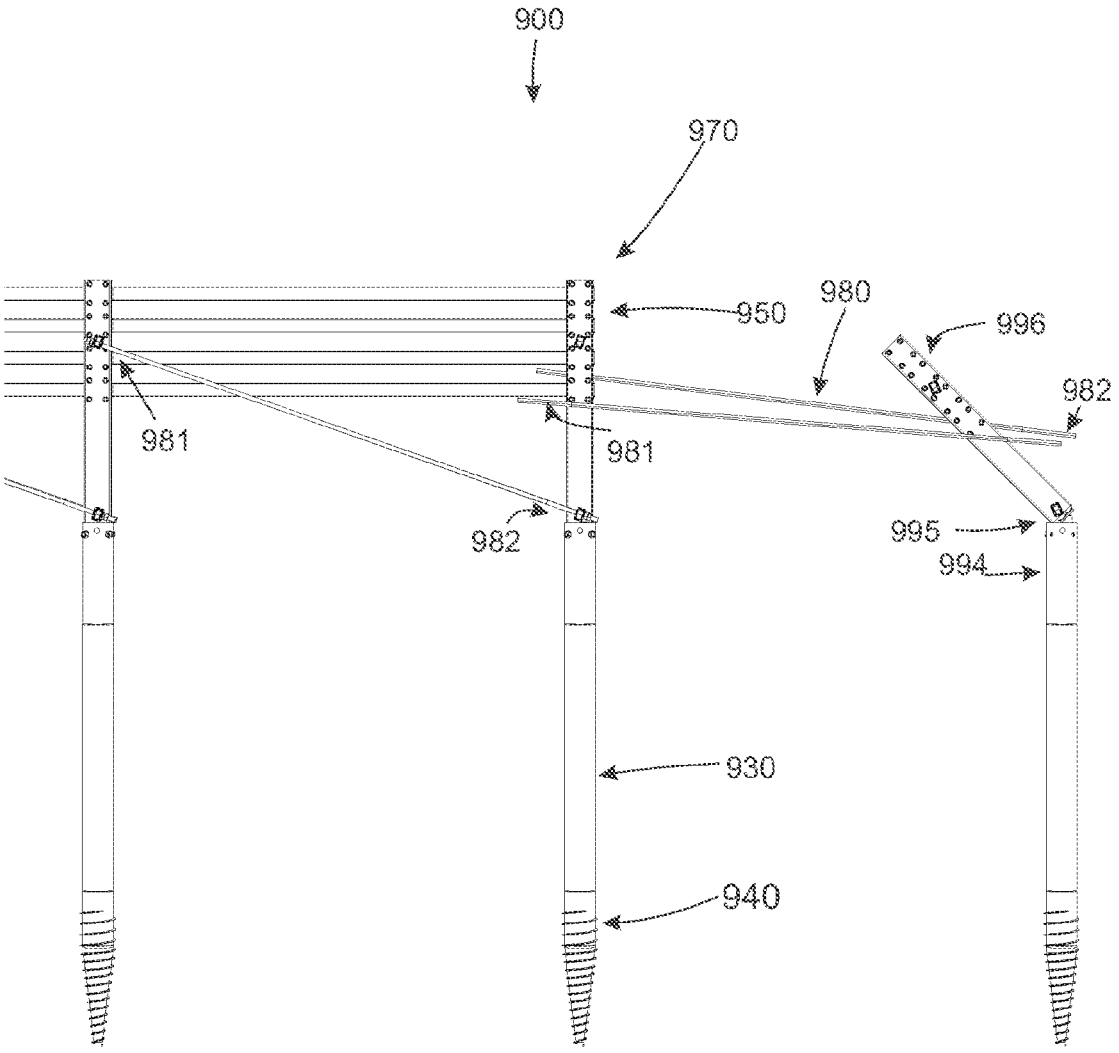

FIG. 24: shows a side view of a portion of FIG. 23, with the terminal end of the end anchor in a collapsed condition.

Figure 25:
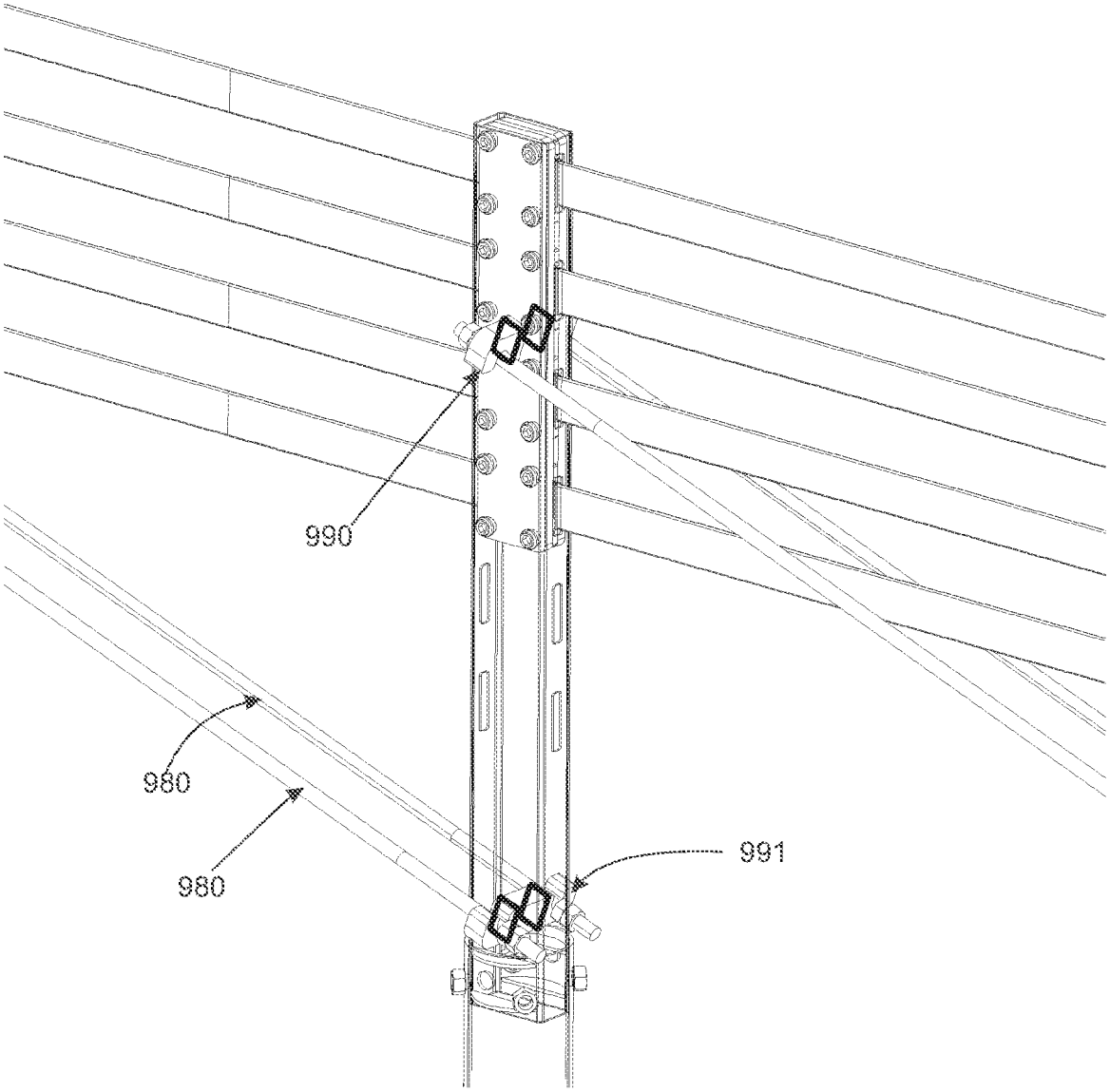

FIG. 25: shows a side perspective view of a supporting arrangement of an end anchor.

Figure 26:
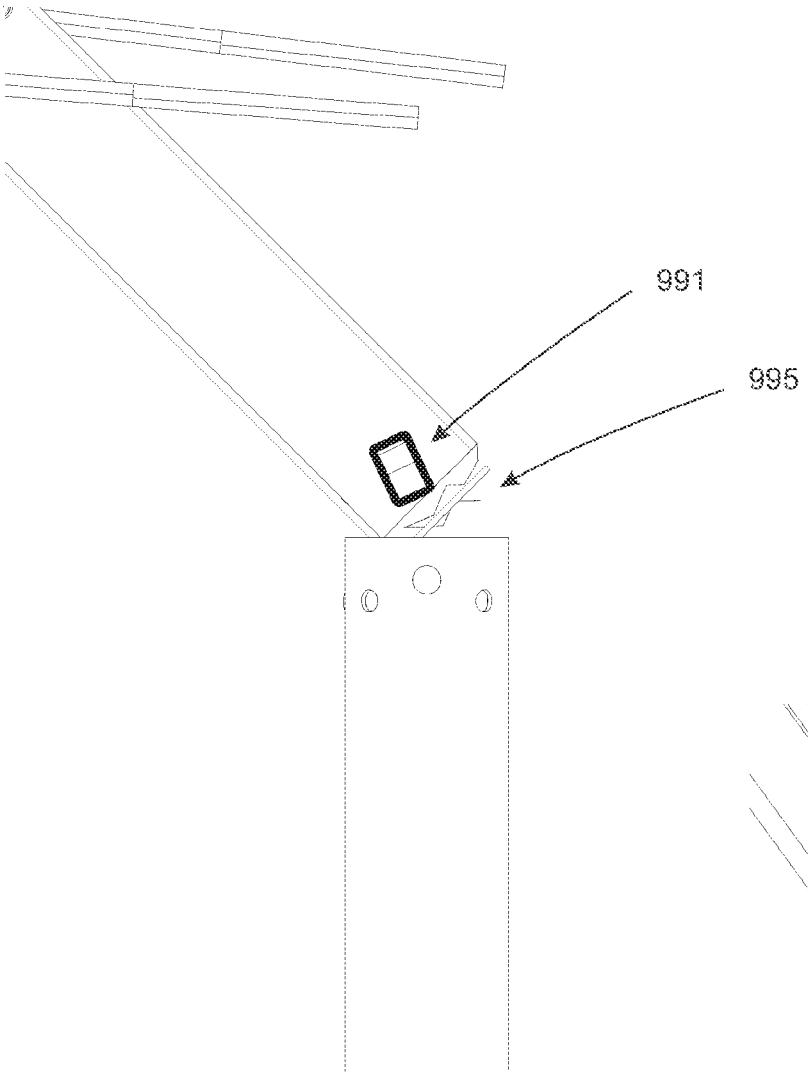

FIG. 26: shows a side view of the collapsed area of an end anchor supporting arrangement.

Figure 27:
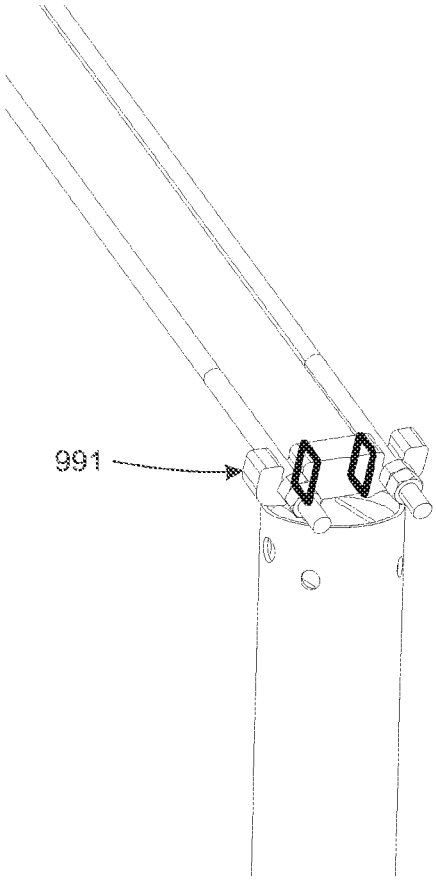

FIG. 27: shows a perspective view of a lower amount with portions of the supporting arrangement hidden.

Figure 28:
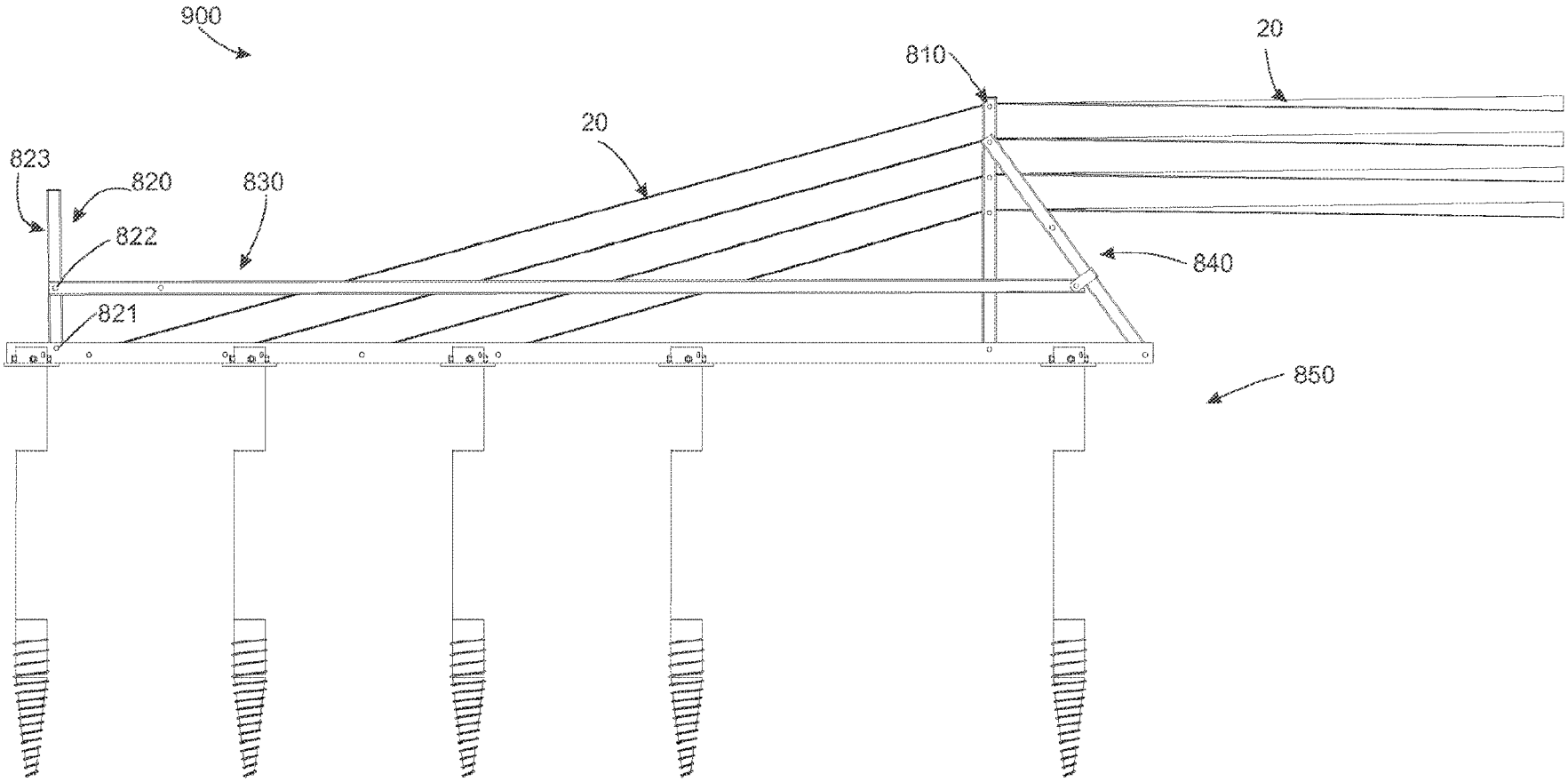

FIG. 28: shows a side view of third embodiment of an end anchor in an operating condition.

Figure 29:
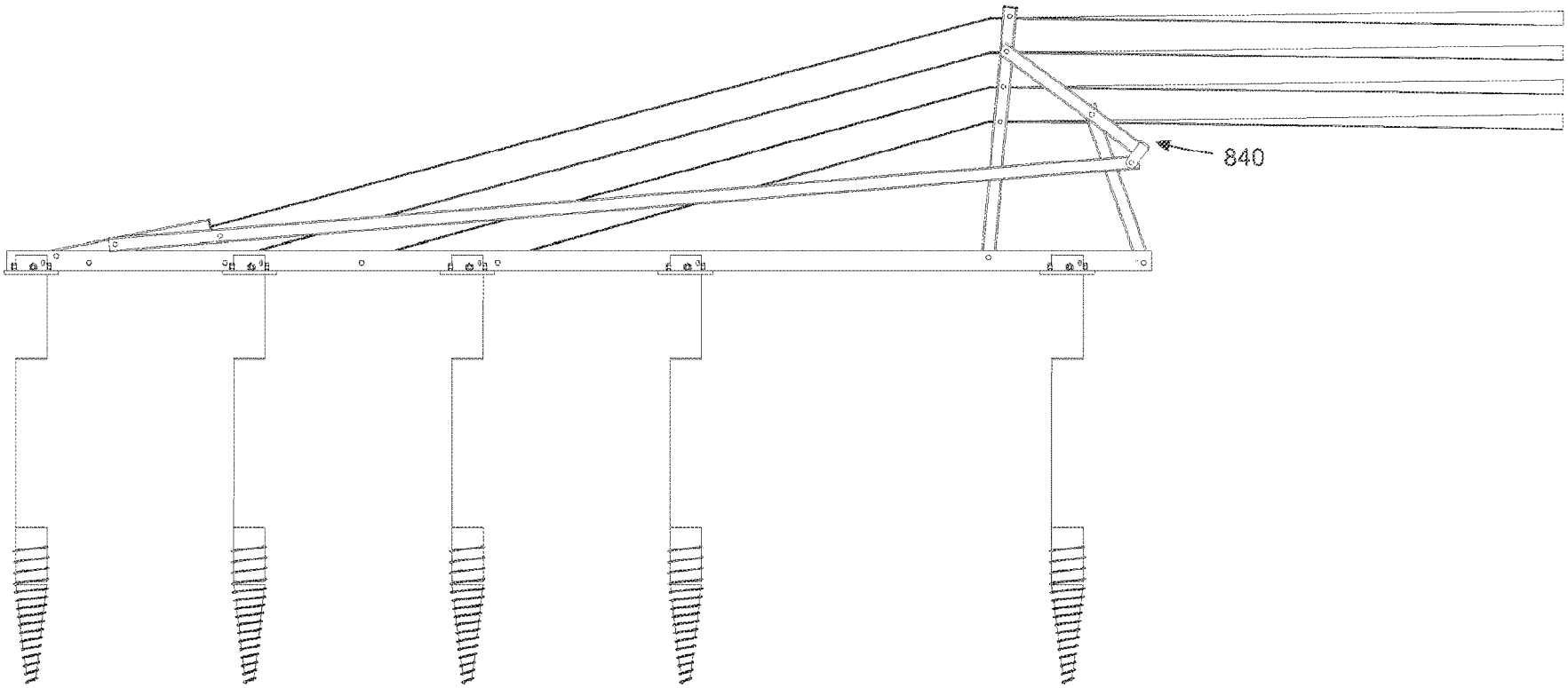

FIG. 29: shows a side view of FIG. 28 and a partially collapsed condition.

Figure 30:
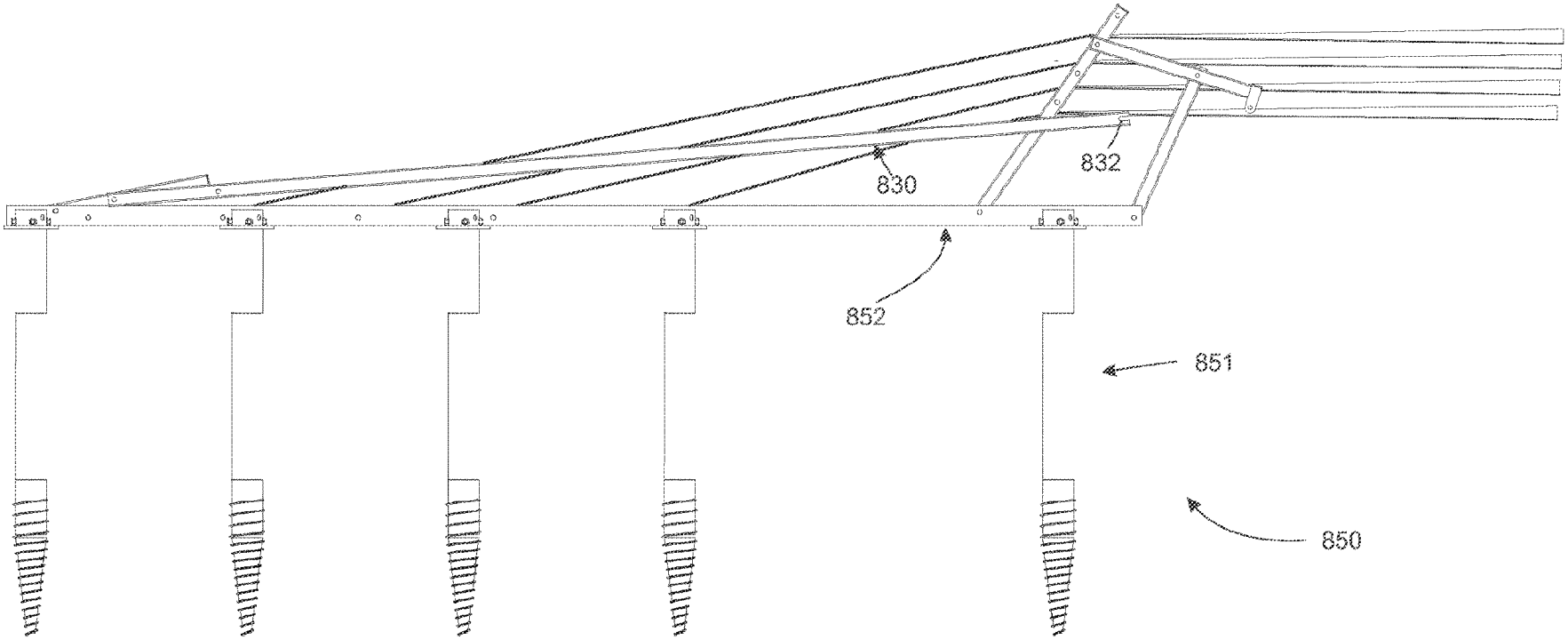

FIG. 30: shows a side view of FIG. 28 and a further collapsed condition.

Figure 31:
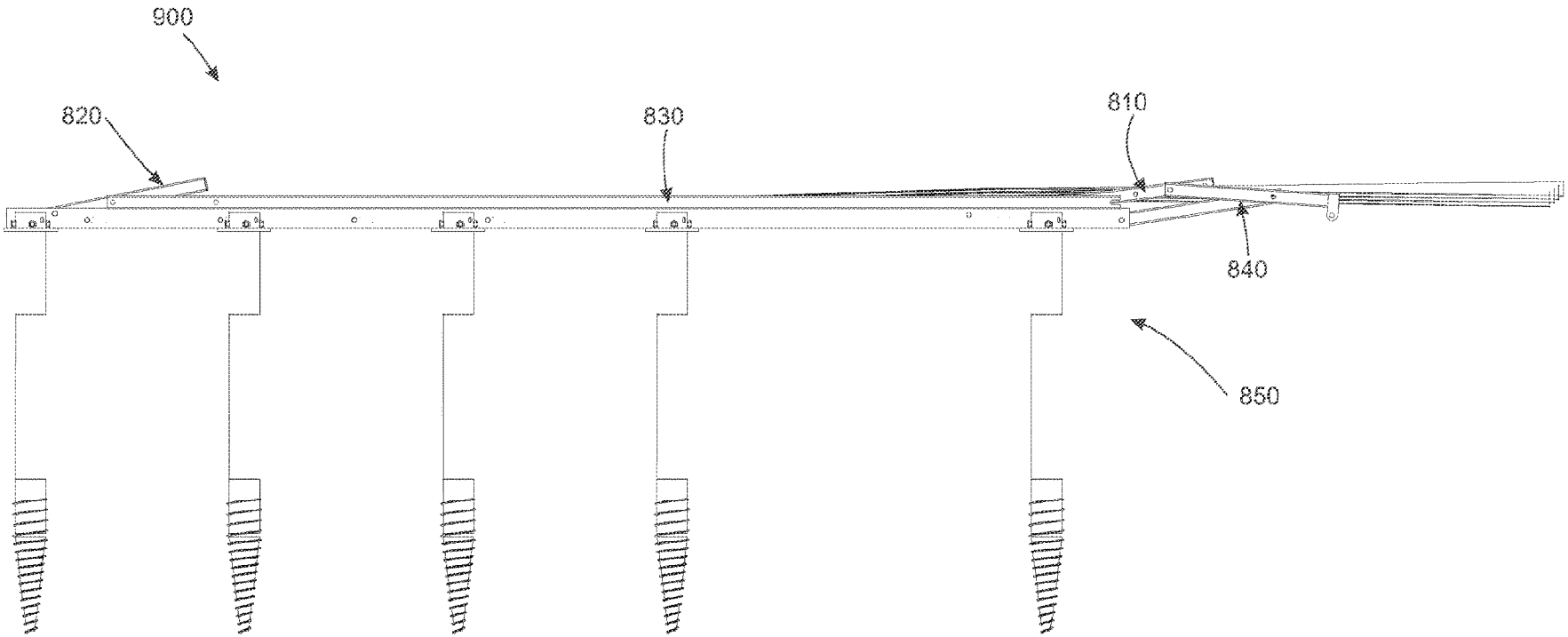

FIG. 31: shows a side view of FIG. 28 in a collapsed condition.

Figure 32:
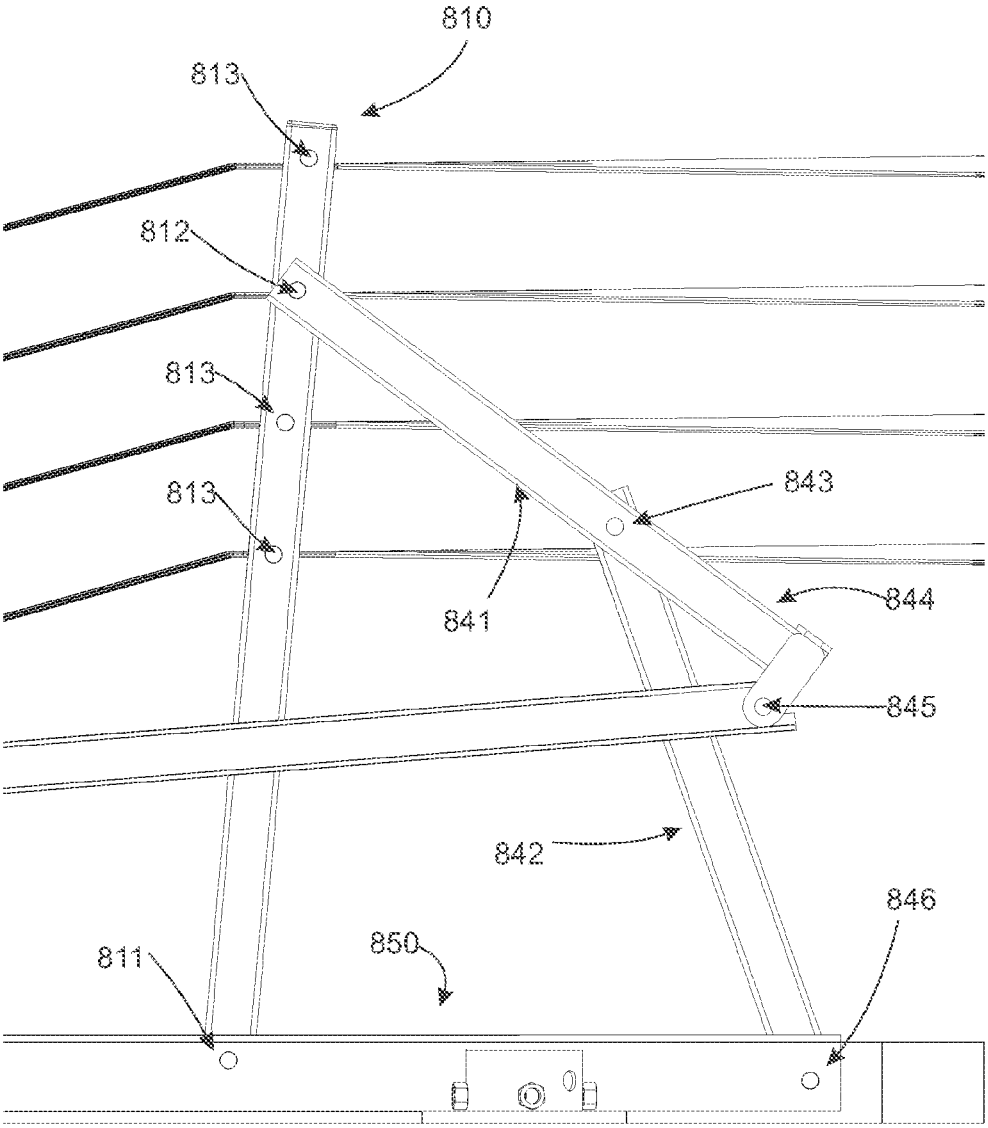

FIG. 32: shows a side view close-up of the supporting post and brace over centre mechanism.

Figure 33:
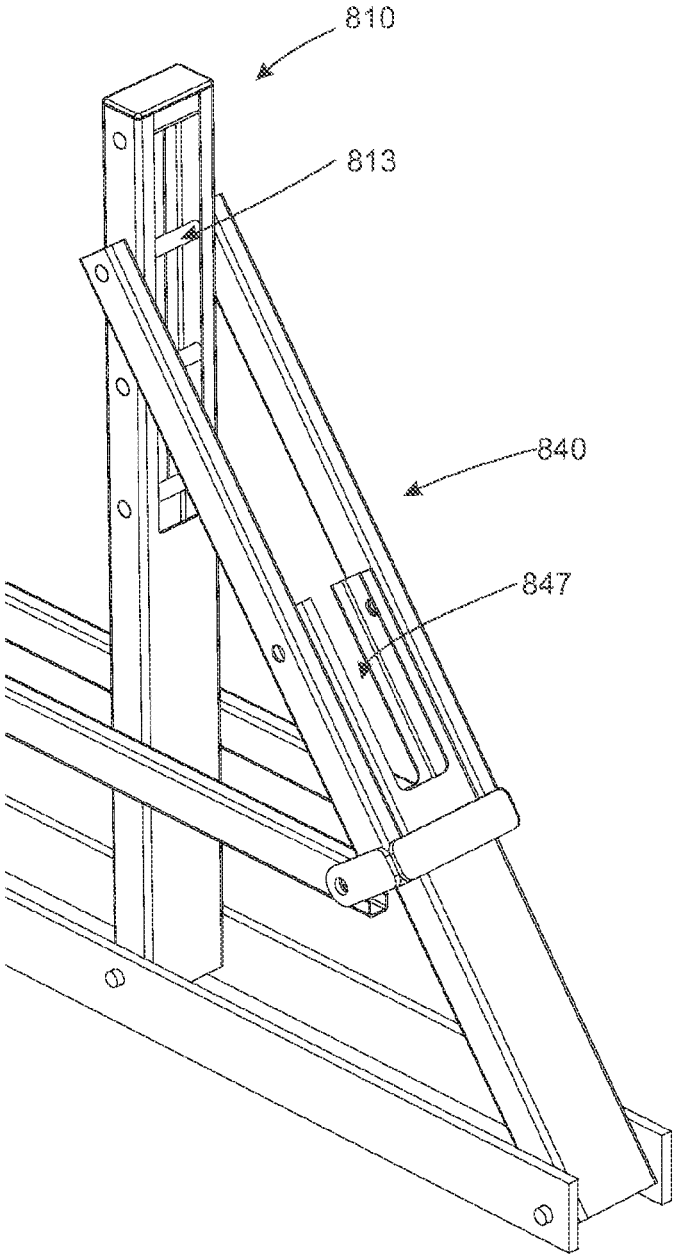

FIG. 33: shows a rear perspective view of FIG. 32 in an operating condition.

Figure 34:
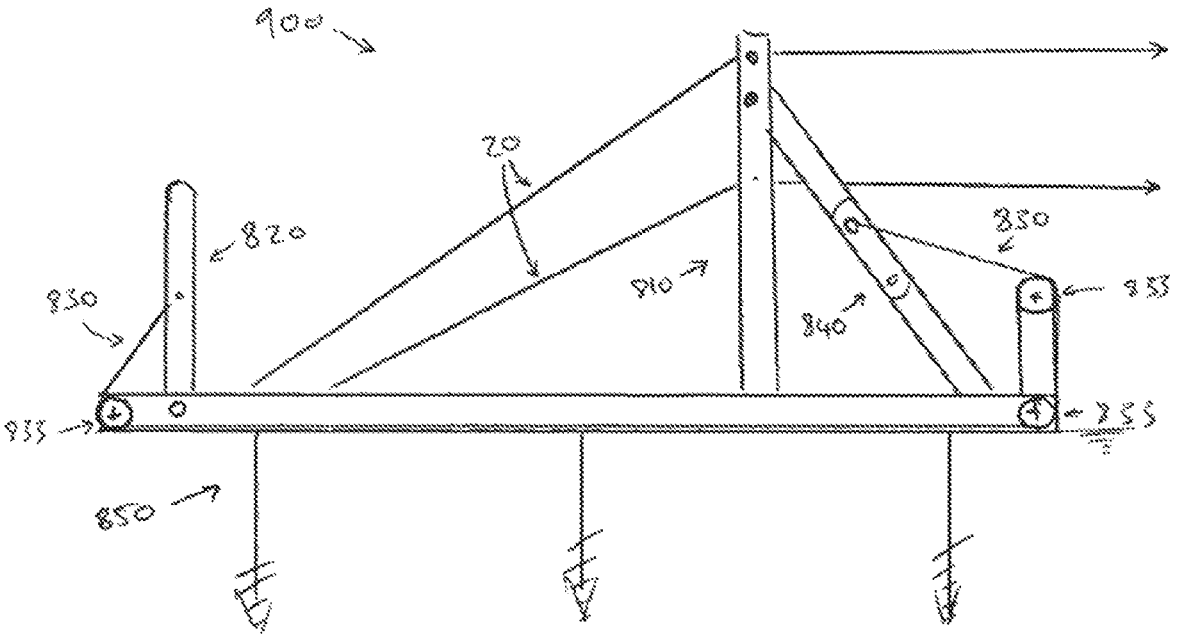

FIG. 34: shows a side view of another embodiment of the end anchor in an operating condition.

Figure 35:
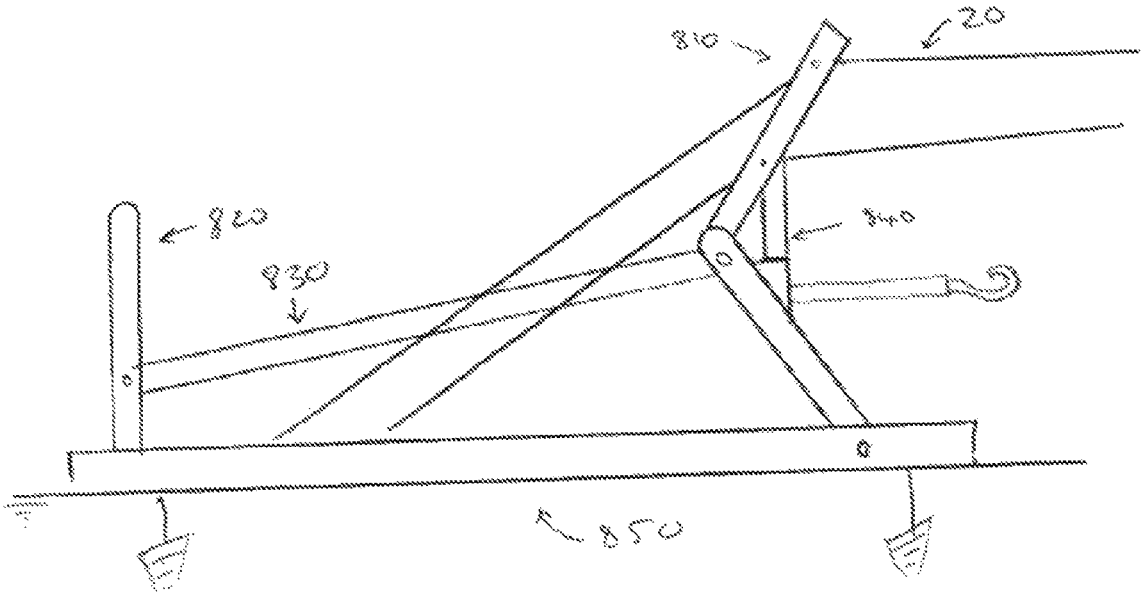

FIG. 35: shows a side view of FIG. 34 in a collapsed condition.

DETAILED DESCRIPTION

With reference to the above drawings, in which similar features are generally indicated by similar numerals, a flexible tensioned crash barrier according to a first aspect of the invention is generally indicated by the numeral 1. A further invention comprises an end anchor to anchor the ends of the crash barrier either end of the length of need, indicated by the numeral 900. The end anchor 900 is preferably used with the crash barrier 1, or may be used with other known barriers that utilise flexible tensioned members. The combination of multiple crash barriers 1 forming a barrier, and the end anchors 900 and other ancillary features is known as the crash barrier system 100.

In one embodiment now described, there is provided a crash barrier 1 as shown in FIG. 1. The barrier 1 generally comprises the following components; a supporting arrangement 70, and one or more flexible members, preferably straps 20 connected to the supporting arrangement 70. The supporting arrangement 70 may be a rigid or semi rigid crash barrier, however, in the preferred embodiment, the supporting arrangement 70 is similar to that used in current flexible crash barriers—comprising a member or upright 30. The flexible straps 20 may be retrofitted onto existing crash barriers, where improved rider safety is required.

A system 100 utilising the crash barrier 1, will have straps 20 extending laterally between multiple supporting arrangements 70, or engaged to and parallel alongside a rigid or semi rigid crash barrier. The multiple barriers 1 form a length of need, where the length is need is the length of barrier between end anchors 900. At each end of the need is an end anchor 900 to hold or ground the straps 20.

The straps 20 define a border or boundary 74 generally colinear the strap's elongate direction 71, as shown in FIG. 7. The straps 20 can subject a vehicle 75 or rider to a direction correction, or at least resist movement past the boundary. The straps 20 act in a similar fashion to traditional wire flexible crash barriers, where the straps 20 are configured to deflect vehicles and riders from the boundary 74, and in doing so absorb some energy from the errant vehicle 75 or rider. A schematic view of a vehicle 75 impacting a crash barrier system 100 is shown in FIG. 11, where there are three crash barriers 1 forming a crash barrier system 100. A vehicle 75 is impacting the middle crash barrier 1 and deflecting it so that the straps 20 are disengaging from the middle crash barrier 1 and deflecting away from the boundary 74.

In one embodiment, the supporting arrangement 70 is comprised of an upright 30 and a mount 50 as shown in FIG. 4. In one embodiment, as shown in the FIGS. 1-7, the straps 20 are engaged at or towards an upper region 32 of a plurality of uprights 30. The upright 30 is mounted to the ground at a lower region 33 of the upright 30. The boundary typically extends between the uprights 30.

Preferably the barrier 1 comprises multiple straps 20, either above and/or below other straps, and/or on either side of the upright 30. The straps 20 are preferably mounted to the upright 30 via the mount 50 that engages with the upright 30. In one embodiment the mount 50 is integral with the upright 30. However, in the preferred embodiment the mount 50 is disengageable with the upright 30 as will be later on described in more detail.

In a crash barrier system 100, the straps 20 are preferably under tension along their length. In a system 100 utilising the barriers 1, at the ends of the need the straps 20 are anchored to an end anchor 900 and tensioned along their length. A variety of end anchors or 'terminal ends' or 'departing ends' as known in the industry may also be used with the crash barrier 1. The end anchor 900 is securely fixed to the ground and redirects or holds the tension forces of the straps 20.

In one embodiment the end anchor 900 comprises a metal ground plate 901 at ground level affixed to a plurality of support arrangements 970 that are screwed into the ground as shown in FIG. 8.

In other embodiments, as shown in FIGS. 23 to 27, the end anchor 900 comprises a number of support arrangements 970, very similar to the support arrangements 70 affixed or the crash barrier, with a truss like system of tensile members 980 redirecting tensile forces of the straps 20 to the bases, anchors 940, or lower region 994 of the supporting arrangement 970. A further embodiment of an end anchor 900 is shown in FIGS. 28 to 33.

Like some other flexible crash barrier systems, upon impact, the upright 30 is able to disengage from the straps 2. In the present invention, the straps 20 are preferably removably engaged to the upright 30, via the mount 50 or via retainers 60.

In one embodiment, the straps are preferably removably engaged to the mount via retainers 60. The retainers 60 are preferably disengageable from the mount 50 when an errant vehicle impacts the crash barrier 1 to move the upright 30 and/or straps 20 away from their static location above the boundary 74. Due to the straps 20 being in tension and resisting movement, and the upright 30 being moved away by a vehicle, the retainers 60 are configured to disengage from the mount 50 to allow the upright 30 and straps 20 to separate from each other.

In other embodiments, the retainer 60 stays engaged with the mount 50 upon being impacted by an errant vehicle; however the mount 50 disengages with the upright 30. In other embodiments, both the retainer 60 and the mount 50 can be disengaged from their respective mountings. I.e. the retainer 60 disengages with the mount 50, and the mount 50 disengages from the upright 30.

FIG. 1 shows a two-sided crash barrier 1 which has three straps 20 on both sides of the upright 30. This type of crash barrier 1 is or could be used to separate two lanes of a road 76. However, the two-sided crash barrier 1 may also be used in situations where a higher redirection strength is required. I.e on one side of a road where many trucks bypass, or where lower strength straps are used so more straps are required to make up the total strength.

In other embodiments, the crash barrier 1 may have straps 20 only on one side (as shown in FIGS. 9, 10 and 14). This type of crash barrier 1 may be used on the external sides of a lane of a road. However, a skilled person in the art may utilise straps 20 on both sides of an upright 30 so there is increased resistance to an errant vehicle, or as a general design variable. The location and number of straps 20 is at the discretion of the engineer.

FIG. 14 shows a one-sided crash barrier 1 which has 6 straps 20 on one side of the upright 30. One of the purposes of the lowermost (one to four) straps is to prevent a sliding motorcycle rider from impacting the upright posts. Preferably the bottom three straps are the primary straps that would engage with an errant rider sliding along the ground. The straps may be different to one another, for example the lowermost straps may be more supple or have a larger face, designed to engage with a rider, whilst the upper straps are stronger yet have a lower surface area configured for engaging with errant vehicles, or other different characteristics configured for their specific use.

The upright 30 is in the general form of a rolled hollow section extrusion. The uprights 30 are common in the art. A skilled person in the art will realise there are many ways of forming an upright 30 that is capable of achieving the correct characteristics required for the crash barrier. The characteristics including, but not limited to, deforming upon impact by an errant vehicle, stiff enough to support the straps 20 in tension, relative the cheaper it is to manufacture, and be able to receive the mount 50. Like the prior art, the upright 30 will have a region of engineered weakness between the upper region and the ground. The region of engineered weakness allows the pivoting or deformation to allow an upper region of the upright to move relative a lower region of the upright.

In the present embodiment the crash barrier 1 comprises a ground anchor 40 configured to engage to the lower region 33 of the upright 30. The ground anchor may be described as being part of the supporting arrangement 70. Preferably the ground anchor 40 is removably connected to the upright 30, however in other embodiments the ground anchor 40 may be integral with the upright 30.

The engineered weakness may be located at a region along the length of the upright 30, or may be at the connection between the upright 30 and ground anchor 40, or both.

In one preferred embodiment the anchor 40 comprises a connection or connections, such as a socket 42, that is able to receive or at least engage with the upright 30 as shown in FIG. 3. The upright 30 can disengage with the socket 42 when required. For example, when replacing an upright 30 that has been damaged onto the existing ground anchor 40. Alternatively, the upright 30 may comprise a socket that is able to fit over the ground anchor 40—not shown. There are many variations envisaged that allow the upright 30 disengage from the ground anchor 40 during impact from an errant vehicle, yet allow a new upright 30 to engage with the existing ground anchor 40.

In one preferred embodiment, the anchor 40 comprises a screw 41. Where the screw 41 is configured to screw into the ground. Ground screw technology is known in the art. Preferably the ground anchor 40 positioned in a controlled manner for quality assurance. Preferably the ground anchor 40 is torqued to a specific torque and/or pull-out force. The depth that the anchor 40 is screwed into the ground may be predetermined by a GPS surveyor. The height and location is recorded to confirmed coordinates with predetermined parameters.

An example of a length of a ground anchor 40 is approximately 1000 mm. However a skilled person in the art will realise that many lengths of ground anchor 40 may be used as required for the specific purpose. For example, the length of the ground anchor 40 may vary between 200 mm and 2000 mm. An upper region of the ground anchor 40 and/or socket 42 is preferably composed of tube. The tube is preferably composed of metal, such as steel, high tensile steel, aluminium, stainless steel, or mild steel. The tube in one embodiment has a diameter of 114 mm, with a wall thickness of 3 mm.

The ground anchor, or components of it, are preferably composed of high tensile steel. In one embodiment, the ground anchor 40 or components of it, have a strength of 350 megapascals, have a skilled person in the art will realise that materials of other characteristics will also be sufficient. In one embodiment the ground anchor 40 is hot-dip galvanized to provide resistance to corrosion. In one embodiment, the upright 30 is comprised of also be of a similar material to the ground anchor.

Where weaker ground formation or soil types are encountered, or where stronger foundations are required, cement grout or other settable fluids may be injected through the ground anchor after installation. This allows the ground anchor to become cemented to the ground, or at least have the engagement between ground anchor and ground become stronger.

Preferably, the supporting arrangement 70, or in the preferred embodiment, the upright 30, ground anchor and/or mount 50, is composed of steel or plastics. The upright 30 is configured to bend, crush, flex, and/or crumple upon vehicle or rider impact. This design allows a number of characteristics. Firstly, the upright 30 is able to be released from, or at least move relative to, the ground anchor 40; secondly the upright 30 is able to move upon being impacted so as not to significantly damage a vehicle or rider; and thirdly, it also allows the upright 30 to move away or release from the straps 20. This allows the straps 20 to try and maintain their location on the boundary 74 without being pulled or moved with the upright 30, whilst the upright 30 is moved away with the errant vehicle or rider.

The upright 30 as previously described may be formed of rolled hollow section (RHS), typically of a size 100 mm by 50 mm. The wall thickness of the RHS may be varied from between 2 mm and 4 mm or what is required to achieve the desired performance or characteristics.

In operation the rectangular section or upright 30 will provide strong resistance to vertical movement of the strap 20 and weak resistance to lateral impact of an errant vehicle. This is similar to the prior art. The point of failure of the upright 30 is preferably at ground level, where the upright 30 is connected to the significantly stronger ground anchor 40. It is intended that when an incident occurs, the uprights 30, mounts 50, and retainers 60 will be replaced into existing ground anchors 40 and the existing straps 20 of the crash barrier 1.

In some embodiments, one as shown in FIG. 9, the supporting arrangement 70 is partially an existing crash barrier, or another support that supports the supporting arrangement to the ground. As can be seen from FIG. 9, the strap 20 can be combined with existing crash barriers. Thus the system may have the characteristics of the present invention, as well as some of the benefits of the rigid or semi rigid barriers. The upright or member 30 as shown in FIG. 9 may extend out at an acute angle from the rigid crash barrier, so that the member 30 can more easily deflect or crumple upon impact by an errant vehicle or rider. In this embodiment, preferably the strap 20 has an ideal deflection that is less than the distance away from the rigid or semi rigid crash barrier.

The present crash barrier system 100 or barrier 1, may be retrofitted to existing crash barrier systems.

Preferably the straps extend in a lateral direction 71 away from the upright 30. However in some embodiments, the straps 20 may be at an angle from the lateral direction 71 from the upright 30, as the crash barrier 1 is extending around a curve or corner.

The straps 20 may be composed of a composite material or a metal material. For example, a composite material may be includes a fibre with a binder, i.e glass, plastics, synthetics, aramids or other type fibre with a resin, binder or filler. In one embodiment, the straps 20 are created from fibreglass and a resin. The straps may be formed by a pultrusion process.

Preferably the straps 20 have a tensile strength of 800 megapascals or greater. However it is envisaged that a skilled person in the art will be able to create a strap 20 according to the considerations and characteristics required by the crash barrier 1. For example there may be more straps 20, with a lower tensile strength, or less straps 20 with a higher tensile strength. Alternatively the straps 20 may have a lower or higher tensile strength depending on their potential working load required. For example, a crash barrier 1 according to the present invention with six straps 20 may have a combined ultimate tensile strength of 1,250 kN on each side of the upright 30.

In one embodiment, the strap 20 is has a rectangular cross section (perpendicular its elongate length). As can be seen from the figures, the straps 20 are generally flat. Preferably the strap in cross section perpendicular it's elongate direction, has a height far greater than its thickness.

In one embodiment the straps 20 have a thickness between 3 mm and 10 mm. Preferably the straps 20 have a thickness of 4 mm. In one embodiment the straps 20 have a height of between 40 mm and 200 mm. Preferably, the straps 20 have a height of between 40 mm and 200 mm. Wherein the height is parallel the direction 72 of the elongate axis of the upright 30, i.e typically vertical.

The flat surface or face 21 has not been seen in the prior art previously. All other flexible crash barriers have cylindrical flexible members to redirect or retain errant vehicles or riders. These cylindrical flexible members have a lower surface area that can cause increased pressures on errant vehicles or riders.

The straps 20 have an internal face 21 that faces (direction 73, a direction normal to the face 21) the lane of a road. The internal face 21, is a major face 21 of the strap. The straps 20 also have an external face 22 opposite the internal face 21 that does not face the adjacent lane of a road. The external face 22 may also be a major face. Preferably at least one of these faces 21 and 22, and preferably the internal face 21, has a relatively large surface area, or is at least substantially planar.

Between faces 21 and 22 is a top edge 23 and bottom edge 24, these may be minor edges or minor faces if slightly thicker. Preferably the top edge 23 and bottom edge 24 are rounded. Preferably these rounded edges are configured so as reduce the ability to slice into vehicles or riders. A radius for a top edge 23 and/or bottom edge 24 is between 2 and 10 mm. Where the radius is larger, then the straps will need to be thicker, however in some embodiments a bead may be applied to the edges so they have a higher surface area and are less prone to cut into objects.

The straps could be of a number of different configurations. As long as the straps 20 have a generally large road facing face 21 that presents a large surface area to an errant vehicle or rider. The face 21 has a normal direction facing the road. The face 21 is generally upright or vertical, or perpendicular the road surface.

Preferably the internal face 21 has a surface which is smooth and not abrasive so to allow a rider or errant vehicle to slide more easily along the length of the strap 20. In some embodiments, a certain roughness may be required to try and arrest or slow down a vehicle or rider.

Preferably the straps 20 do not have edges, connections, and/or protrusions that present themselves outward from the lateral direction 71 of the straps 20.

The figures show an embodiment with three straps 20. However in other embodiments, there may be only one or two straps, or more than three straps. For example, there may be anywhere between one and ten straps on one side of an upright 30. If there is only one strap 20, that strap may have a larger cross-sectional area, i.e. present a larger surface on the face 21 to the adjacent lane of a road compared to where multiple straps are used. FIG. 12 shows an embodiment with six straps on one side. This embodiment is a two sided version, so there are another six straps on the other side of the upright 30. The straps 20 on the other side may act at deflect vehicles coming from either side of the upright.

Preferably in some embodiments the straps 20 are as close to the ground. This prevents an errant rider from sliding underneath the straps. FIG. 12 shows an embodiment where the straps 20 are configured to be near the ground in use. A preferred height from the ground is between 100 mm and 200 mm.

Where there are multiple straps 20 in a crash barrier system 100, there may be gaps between adjacent straps 20. The gaps may be between 10 mm and 100 mm in height. Preferably the gaps are 50 mm in height. The gaps i.e. the distance between the straps 20, may be configured depending on the characteristics required for the crash barrier system.

Where there are multiple straps 20 in a crash barrier system 100, the straps 20 may be identical to each other, or may differ from each other. Such difference may be in; composition, location, size, and/or physical characteristics, etc.

Preferably the straps 20 are tensioned between their ends, along the elongate direction 71. In one embodiment, the combination of straps 20 on one side of the upright 30 is pretensioned to a combined tension (all of the straps on one side) between 100 kN and 400 kN, however they may be tensioned higher or lower. A typical combined pretension of wire rope flexible road crash barriers is around 80 kN.

The straps 22 not extend between pay-outs, brakes or spools. The straps 20 are affixed to the end anchors and there is no pay out of extra strap. This is not a vehicle arresting system configured to arrest vehicles from entering a premise or similar. This is a road crash barrier and is configured accordingly.

The higher strength of the straps 20 compared to the prior art flexible members (i.e wire rope), means higher pretension can be achieved, and hence the ability for the system 100 to reduce the distance an errant vehicle passes past the boundary 74. In one embodiment, the strap has an E value between of 40 GPa and 210 GPa.

In other embodiments the straps are composed of metal. In one embodiment and the straps are composed of high-strength ductile steel. Preferably the ductile steel has a high yield capacity and has elongation after yield. Where high yield capacity is a yield strength greater than 450 MPa.

The steel strap must be ductile. Preferably also be capable of elongation of more than 9%. During an impact this means the barrier will provide full restraint at yield strength. During yield the strap will elongate and in an extreme situation arrest the impacting vehicle over a greater deviation. This is not the case with some prior art wire rope in which the elongation before failure is elasticity, not yield. This means in an extreme case wires will break and become a serious hazard.

In one embodiment, the steel strap is composed of 450 grade steel, with a 530 MPa yield, and elongation of 15% after yield. However, there may be many other variations on grade, yield strength and elongation that are applicable for particular crash barrier requirements. Preferably the steel strap is 3 mm in thickness, but thickness may vary depending on barrier requirements. Preferably the strap has a height (also the front face height) of 55 mm.

In one embodiment the strap is composed of two or more layers of strap. This may be applicable for both composite and metal, and it may be a combination of the two. In one embodiment the strap is a double layer of steel. It is an object of the strap to reduce the ability of errant vehicles to penetrate or pierce the strap. Having two layers of straps, and in particular, two layers of steel straps will reduce the likelihood of penetration of the second layer.

Where steel straps are used, it is recommended that the edges should be rounded or otherwise protected to prevent injury. On the uprights or upper edges of the upright or retainer there should be rounded edges or a cap to prevent injury. The cap may be composed of plastics. The steel strap may comprise a plastics coating.

The length of straps in a system may be between, 20 m and 2 km. The straps may be connected to each together to extend their length.

In one embodiment, the retainer 60 is configured to retain the straps 20 to the mount 50 whilst the system is at its static or non-impacted condition.

The mount 50 and/or retainer 60 serve to secure the straps 20 to the upright 30 until vehicle impact. After or during impact;

a) the mount 50 disconnects from the upright 30, and the retainer 60 stays connected with the mount 50 and straps such the straps act as a net to deflect errant vehicles, or
b) the mount 50 disconnects from the upright 30, and the retainer 60 disconnects from the mount 50, allowing the straps 20 to be free, or
c) the mount 50 stays connected with the upright 30, and the retainer 60 disconnects from the mount 50 and stays connected to the straps 20.

In a preferred embodiment, the mount 50 remains connected with the upright 30 and the retainer 60A/606/60C (aka retainer assembly 60) disconnects from the mount 50. The retainer assembly 60 retains the straps in relation to each other so the straps 20 act together as a combined deflector even when disconnected from the mount 50.

In an alternative embodiment, the mount 50 disconnects from the upright 30 and the retainer 60 also pops off from the mount 50, so the straps 20 are free from the impacted supporting arrangement 70.

In one embodiment, as shown in FIGS. 1-6, the connection 51 of the retainer 60 to the mount 50 is configured as a weak point to allow disconnection from the mount 50 at a predetermined force or movement. This predetermined force or movement is typically achieved during impact from an errant vehicle into the road barrier 1 (i.e. with the supporting arrangement 70, or the straps 20). The connection 51 of the retainer 60 from the mount 50 may be a snap disconnection. Where parts of the mount 50 and/or retainer 60 flex or bend to allow disengagement between the two. The disconnection of the retainer 60 from the mount 50 may be in a direction 73 perpendicular to both the upright elongate direction 72 and strap elongate direction 71. There are many ways of engineering a system or connection that can disengage upon high forces. For example, the mount 50 may have frangible tabs 65 that engage with the retainers 60, that are broken or deformed upon impact of a vehicle with the barrier 1.

In a further embodiment, the connection 51 of the retainer 60 to the mount 50 may also act by sliding in a direction parallel the elongate axis direction 72 of the upright 30. This allows the retainer 60 to engage or re-engage with the mount 50. One possible connection 51 is seen in FIG. 4, and alternative connections are shown in FIG. 13 and FIG. 15. A barb or snap type connection is shown in FIG. 13, where FIG. 13 shows a top cross-sectional view of the road barrier of FIG. 12.

The engagement and disengagement direction of the retainer 60 with the mount 50 in the embodiment of FIG. 13 is the same.

In a further embodiment, a plug type retainer connection is shown in FIG. 15, where FIG. 15 shows a side cross-sectional view of the road barrier of FIG. 14.

Allowing the straps to be free of both the mount 50 and upright 30 allows the straps 20 to deflect away from the boundary 74. The straps 20 may deflect by 1-2 metres from the defined boundary 74 during a process of redirecting an errant vehicle or rider.

The straps when retained by the retainer 60, may be held between the retainer 60 and a surface 51 of the mount 50. Preferably the straps 20 are retained in the upright 30 elongate direction 72 by a recess 52 and guide on the mount 50, and/or on the retainer 60. These features may be modified depending on the characteristics required of the road barrier 1, for example how close together the straps 20 are to each other, how thick the straps are, etc. The straps are preferred to held or clamped in by Lurethane, steel, or other like materials.

In one embodiment, the mount 50 and retainer 60 stay engaged with the straps 20 after impact, to allow the straps to stay in their pre-impact arrangement. i.e the straps are engaged to one another, so they continue to work together or at least move together.

In one embodiment, for example with a two-sided road barrier 1, the impact side retainer 60 may pop off from the mount, whilst the other retainer 60 stays retained to the straps external to the road side. The mount for example, may stay retained with the straps 20, and the upright 30 may slidingly disengage from the mount 50 as it is impacted by the vehicle.

Alternatively the straps may be held between an outer retainer 60A and inner retainers 60B and 60C, which are connected with plugs 62 that engage with slots 56 in the mount 50. This is shown in FIGS. 14-17. The retainer 60 is engaged to the mount 50 by the plug 62. In alternative embodiments, a separate connection means is used to connect the retainer 60 to the mount 50, that is separate from the plug 62.

In the embodiment shown in FIGS. 14-17, the inner retainer 60A and the outer retainers 60B and 60C, connected by plugs 62, stay engaged with the straps 20 after impact, to allow the straps to stay in their pre-impact arrangement.

The plugs 62 may be configured such that the strength of the connection between the retainers 60A, 60B and 60C is greater than the strength of the connection between the retainer 60 and the mount 50. In one embodiment, the plug 62 and retainer configuration allow disconnection of the retainer assembly (the retainer assembly comprising the retainers 60A-C) from the mount 50 at a force of 10 kN. Where preferably this force is direction 73, however forces in other directions may increase or decrease the pull out strength of the plug 62 from the mount 50.

The plugs 62 may be composed from a polymer material which may be reinforced with fibres to form a fibre-reinforced polymer. The polymer material used may include nylon, epoxy resin, or silicone. The fibre material used may include glass, carbon, aramid, basalt, or like fibres. In a preferred embodiment the plugs 62 are fabricated from 30% glass fibre reinforced nylon. Preferably the plug has some give or flexibility that allows it collapse inwards or deform so it can be pulled through the slots 56 during impact. In other embodiments the plug has frangible sections.

To install the straps 20 onto the mount 50 of the road barrier 1 shown in FIG. 14, the plugs 62 are used to create a retainer assembly. The plugs 62 are first pressed through the holes in the outer retainer 60A. The straps 20 are then aligned with the top of each plug 62 before the plugs are pressed through inner retainers 60B and 60C, such that the straps 20 are secured between retainers 60A and 60B. In one embodiment, the inner retainers 60A and 60B may be slightly taller than inner retainer 60C such that the top cap 63 can be placed over the top ends of retainers 60A and 60B to secure the contained top strap 20 against vertical movement, and/or along with an extra retention between the retainers 60A and 60B. The retainer assembly (60A-C) can then be mounted by vertically slotting the ends of the plugs 62 into the slots 56 on the mount 50. A cross-section of the final assembly is shown in FIG. 15.

The connection of the plugs 62 to the slots 56 in the mount 50 is configured as a weak point to allow disconnection of the retainer assembly 60 from the mount 50 at a predetermined force or relative movement. This predetermined force or movement is typically achieved during impact from an errant vehicle into the road barrier 1. The disconnection of the plugs 62 from the mount 50 may be in a direction 73 perpendicular to both the upright elongate direction 72 and strap elongate direction 71, or any combination of the above. The disconnection may be facilitated with frangible, or engineered weakness mounting tabs on the plugs 62, or by an engineered weakness of the slots 56 or the plugs 62. Alternatively, and/or in combination, impact forces may cause the plugs 62 to move vertically within the slots 56, thereby causing disconnection.

In one embodiment, the plugs 62 have exterior circumferential surfaces of varying diameters suitable to engage with holes in one of the retainers, or with slots 56 of the mount 50. The outer surface 80 sits in a hole of outer retainer 60A, and also supports a strap 20. The intermediate surface 81 sits in a hole of inner retainer 60B, while the inner surface 82 sits in a hole of inner retainer 60C. The mounting surface 83 slots into a slot 56 of the mount 50. These surfaces are shown in FIG. 16.

Preferably the retainer 60 is of a low profile design so to be as flush as possible with the surface of the face 21 of the straps 20.

The mount 50, and/or other features of the upright 30 or ground anchor 40, do not significantly protrude past the straps 20 towards the road. Preferably the retainer 60 is significantly flush or planar with the external face 21 of the straps 20. Preferably the external surface of the retainer 60 does not extend more than 6 mm past the external face 21 of the straps 20. The significance of this is that a motorcyclist sliding along the barrier will not impact or become hung up on a large protrusion. On current barriers posts, motorcyclists may encounter a protruding metal post.

In alternative embodiments the retainer 60 may extend further past the face 21. In this embodiment, preferably the retainer 60 slopes gradually from the face 21 to inner most roadside facing surface of the retainer, this may reduce point impacts to a vehicle or rider. A slight chamfer 63 can be seen on the retainer 60 in the figures, this reduces point loading or edges that could snag or impact a rider.

In one embodiment, as shown in FIGS. 18-20, straps are held between a retainer 60, which is connected with plugs 62 that engage with slots 56 in the mount 50. The mount 50 comprises a tab 65 that will facilitate the disengagement of the plug from the slot as described herein previously. In this embodiment, the mount and/or upright is a C shaped post. Further, the slot 56 is a height that facilitates the plug 62 to have a larger direction of travel before engaging with the tab 65. This allows a greater vertical movement of the straps before disengagement with the mount. These elongated slots require an upward movement of the strap to separate the straps from the supporting arrangement and this ensures the straps are held in a correct position for vehicle engagement and does not release early too early during impact.

In one embodiment, as shown in FIGS. 21 and 22, rivets 64 hold the retainer 60 and straps 22 the mount 50. The rivets 64 comprise a deformable sleeve or feature 64*a* that can perform during vehicle impact into the crash barrier. The deformable sleeve or feature 64*a* is able to release the retainer from the mount 50.

End Anchor—Second Embodiment

The end anchor 900 may be described as including the support arrangements 70 that affix to a ground plate 901, as well as ancillary features such as tensioning arrangements etc. In other embodiments, there is no ground plate 901 or base.

In one embodiment, as shown in FIGS. 23 to 27, and described at the beginning of this specification, an end anchor may comprise multiple (at least two) support arrangements 970. At least one support arrangement 970 has an upper region 996 with an upper mount 990 is location, and at least one support arrangement 970 has a lower region 994 where a lower mount 991 is location. One or more, preferably two, tensile members 980 extend between these two mounts. The tensile members 980 can be tensioned by fastening means at one or both of their respective upper end 981 and lower end 982. The tensile members 980 are configured to redirect the tensile forces from the straps 22 to the lower region 994 nearer more the ground. Redirecting the tensile force of the strap to the lower region 994 provides less moment on the supporting arrangement, and a greater ability to hold the strap tension. Where the straps are attached at or near the upper region 996 by the upper mount 990.

And even vehicle that impacts the from the terminal end of the end anchor 900 should not flip or be raised off the ground significantly. For this to occur ideally the end anchor 900 has features that allow the vehicle to stay underground. An embodiment as shown in FIGS. 23 to 27, the supporting arrangements 970 have a collapsible region 995 below the lower mount 991 and above the ground surface. This collapsible region is configured to collapse upon impact of an errant vehicle to the supporting arrangement 970.

Upon collapse, pivoting or deformation of the collapsible region 995 the upright 930 of the supporting arrangement 970 effectively rotates. This rotation of the upright 930 brings it closer to the adjacent supporting arrangement 970 that is connected by the tensile members 980. The one or both of the upper amount 990 and lower mount 991 have features that allow the tensile members 980 to be released from the respective mounts should the upright 930 be rotated. In one embodiment one or both of the upper mount 990 and the amount 991 have slots 992 993 that allow engagement and disengagement of the tensile members 980. When the mounts rotate, or move towards each other, the tensile members no longer hold tension and as such are unlikely to cause an errant vehicle to flip. The system removes horizontal restraint in one direction along the barrier. In some embodiments the end anchor allows the barrier to collapse when the end is struck be a vehicle but provide tension in the other direction to keep the strap tension for the crash barrier.

The supporting range 970 comprises to 2 m long ground screws 940, these may reduce the need for a concrete base. The current embodiment of end anchor as shown in FIGS. 23 to 27 has the following reference numerals:

900 End Anchor
901 plate
970 supporting arrangement
930 upright
940 Ground screw
950 Mount
980 tensile member
  981 upper end
  982 lower end
990 upper mount
  991 lower mount
  992 upper mount slot
  993 lower mount slot
  994 lower region
  995 collapsible region
  996 upper region End Anchor—Third Embodiment In order to comply with the AASHTO MASH American standard used by New Zealand and Australia, a crash barrier system that is impacted end on by a misdirected vehicle, the system must not cause the roll over by the test vehicle. This may be by accelerating the vehicle vertically. By snagging the vehicle, causing it to yaw and then roll. For a low cost barrier system it is preferable that the worst case vehicle (one of light weight 1100 kg) proceeds through the anchor without roll or redirection.

In order to meet the requirements of NZ and AU authorities (not the AASHTO standard), it is desirable that after an impact collapsing an end terminal, that the barrier system which may be one kilometre long remains in position and is functional. It is acceptable that the barrier is no longer pretensioned, but the ends remain securely held.

It is also desirable for NZ and AU authorities that after any accident on the length of need, that first responders can de-tension the length of road barrier. Likewise, it is preferable that the end anchor can be moved back from the collapsed condition to the operating condition where the flexible members are fully tensioned. Optionally a first responder can use a vehicle bumper to apply a force to a trigger, such as a trigger post, and release the tension in the tensioned members 20 if required.

This anchor system described above, and shown in FIGS. 28 to 30 provides the above functionality. The drawings reference the following reference numerals:

900—End Anchor
810 Support post
  811 Base hinge
  812 Support-Brace hinge
  813 Tensioned member supports
820 Trigger post
  821 Base Hinge
  822 Beam-Trigger Hinge
  823 Upper region
830 Actuator
  831 Brace-Beam Pivot
  832 Slot
840 Brace
  841 Upper Section
  842 Lower Section
  843 Pivotable section
  844 Lever
  845 Pin
  846 Brace-Base Hinge
  847 support post slot
850 Support unit
  851 Anchors
  852 Plate One of the requirements of AASHTO (American Association of State Highway and Transport Officials) is that if an errant vehicle impacts the terminal end of an end anchor 900 of a road barrier 1, the vehicle should not roll. The Transport Authorities in NZ and Australia preferably require that the end anchor "readily breaks away, or fractures, or yields, allows controlled penetration, is traversable without causing serious injuries to the vehicles occupants". The end anchor 900 may also be known as a Terminal End. However, in this specification, the terminal end is described as the terminal end of the end anchor 900, farthest away from the road barrier 1, and facing oncoming traffic towards the end anchor 900. The end anchor 900 also has a road barrier end closer more the road barrier 1 and opposite the terminal end.

FIG. 28 shows an end anchor 900 with a trigger 820 that is configured to engage with an errant vehicle oncoming the terminal end of the end anchor 900. The trigger may be a post, or other member that is able to actuated. The vehicle is configured to trigger (by impacting) the end anchor 900 so the end anchor (or at least part of it) collapses to reduce its height. The collapsing of the end anchor 900 also lowers the tensioned members 20 towards the ground so as to prevent flipping or riding up of the vehicle on the tensioned members. Lowering the tensioned members 20 also reduces the tension within the tensioned members 20. In one embodiment, the collapsed height of the end anchor 900 is less than the vehicle clearance (e.g. 18 cm) ensuring that the passenger compartment floor is not penetrated and thereby avoiding passenger injury.

FIG. 29 shows the trigger post being impacted (vehicle hidden for clarity) and partially collapsing the end anchor 900. FIG. 30 shows a subsequent view of FIG. 29, where the end anchor 900 has collapsed further. FIG. 31 shows the end anchor 900 fully collapsed. Details of how the anchor 900 operates follow.

The trigger post is pivotably engaged, at a base pivot 821, with a support unit 850 that is affixed to the ground. On the trigger post 820 and above the base pivot 821 is located an push beam-trigger post pivot 822 that pivotably engages with an actuator 830, such as a push beam 830. I.e the trigger post acts as a lever to actuate the push beam 830. The push beam 830 is rigid and can act in compression so it can transfer movement of the lever. The push beam 830 may be made up of multiple beams acting as one, as shown in the figures. The trigger post 820 has an upper region 823 above the pivot 822. The upper region 823 acts a lever extender that allows the trigger post to more easily and likely engage with a vehicle, it also provides further leverage from the vehicle about the pivot 821.

The push beam is configured to pivotably engage, and be able to push, a brace 840 that braces a support 810 with the ground unit 850 towards the road barrier 1. The support 810 is preferably a post that vertically supports flexible and/or tensioned members 20 (and in some embodiments these are the straps 20 herein described) via tensioned member supports 813. The support may be any member or shape able to also redirects the straps 20 vertically towards the support unit 850 which retains the ends of the straps 20. The support unit 850 retains the ends of the straps 22 and maintains tension within the straps 20.

The support post 810 is pivotably engaged with the support unit 850 at a base pivot 811 as shown in FIG. 32. The brace 840 in the braced condition braces the support post 810 so that it cannot fall/pivot towards the road barrier 1 under the tension of the straps 20. The brace 840 acts as an over centre mechanism via a central pivoting section 843. Should the brace 'break' or hinge about this pivoting section 843, then the brace is able to collapse, or at least not withstand compression, so as to remove its, or a partial amount of, bracing effect on the support post 820.

Should the trigger post 820 be engaged by a vehicle, the trigger post 820 will push the push beam 830 across and into the brace 840. The push beam will move the brace 842 to a collapsed condition which allows the tension of the straps to pull down the support post 810. In doing the above, the straps 20 at the end anchor are lowered to or towards the ground and at angle up to the nearest supporting arrangement. This creates a low angle of incidence of the straps 20 with ground level, and thus this reduces the likelihood of a vehicle from riding up the straps and flipping over. There is also no rigid upright that could pierce or severely damage a vehicle. Should the vehicle continue past the end anchor 900 it could carry onto the deformable supporting arrangements should they be present as described herein.

Detail of the over centre mechanism is shown in FIG. 32. Where it can be seen that the brace 840 is divided into an upper section 841 and a lower section 842. The upper section 841 beam be engaged at a pivoting section 843 with the lower section 842. The upper section 841 extending past the pivoting section 843 via an arm 844. It is the arm 844 that the push beam in this embodiment is pivotably engaged with at a pivot 845. As can be seen in FIG. 33 the push beam 830, as well as parts of the brace 840 is divided into two arms so as to allow the support post 810 to move therebetween.

FIG. 30 and FIG. 32 an angle in the tensioned members towards the terminal end and past the supporting post 810 is seen. This is a discrepancy in the figures, as these members 20 are preferably flexible and in tension thus a straight line should be seen between the tensioned supporting member supports 813 and where the strap 20 affix to the support unit 850. The supporting unit 850 comprises a plate or rigid connecting member 852 that allows the other described features to be connected thereto. Also, this plate 852 allows for ground screws and anchors 851 to anchor the end anchor 900 to the ground. In some embodiments the supporting unit 850 may be partially encased in concrete or other anchoring systems is used in the arts.

Where the pivoting sections 821, 822, 811, 846 etc are described as well as in other areas of this specification, the pivoting can occur via deformation, pliability, or other hinging actions, and not only a pin type arrangement as shown in the figures. However, a pin type, or other efficient pivoting systems are most effective as they are less prone to damage, and the system can be reset to an operating condition if there is no damage elsewhere.

In another embodiment, as shown in FIG. 34 the actuating member 830 is a flexible member, such as a rope, cable, strap, strop, or wire. The end anchor 900 operates in a similar fashion to the previously described embodiment, except that the trigger 820 actuates the actuator 830 which in turn is able to pull on the brace 840 to 'break' the hinge of the brace so the brace 840 no longer braces the support 810. In this embodiment the end anchor 900 will comprise ancillary features such as pulleys and suitable to guide the actuator 830 from the trigger 822 the brace 840. For example there may be multiple pulleys or wheels 833 to guide the actuator 830.

In another embodiment as shown in FIG. 35, the actuator 830 is a push beam that directly acts on the support 18. The brace 840 is inbuilt with the support 8 to 10. The push beam at 30 may act on either the support 18 or the brace 840. In this embodiment there is only one connection between the support and the brace to the support unit 850. This embodiment the support 18 will need to be pushed over centre to break the support 810 from the operating condition to the collapsed condition. Between the trigger 820, actuator 830 and support 18 it needs to be suitable such that the trigger 820 is able to push the support 18 far enough to break it over centre. FIG. 35 is a schematic only, however as skilled person in the art will be able to determine the correct geometry required. FIG. 35 also shows an ancillary feature such as a hook that may be actuated by a user or vehicle to pull the end anchor from the operating condition to the collapsed condition should it be required. This may be examples where the road barrier needs to be collapsed, but a vehicle has not triggered the trigger 820.

In one embodiment, the end anchor 900 and its primary components are composed of metal, preferably steel.

In one embodiment, the flat straps 20 of the present invention may be substituted into a modified traditional wire barrier support arrangement. In this embodiment, not all of the benefits of the present invention will be achieved—such as a continuous smooth sliding surface. Yet, other benefits, such as increased tensile strengths and larger impact area (the flat face 21) may be achieved.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

The invention claimed is:

1. A roadside crash barrier for deflecting errant vehicles, the barrier comprising:

a plurality of elongate tensioned flexible straps each comprising a planar face arranged for engaging an errant vehicle and/or rider, and a supporting arrangement configured to support the straps above the ground in use, wherein the supporting arrangement comprises:

an upright member, and a retainer configured to secure the straps to the upright member via a releasable connection comprising one or more plugs arranged to engage one or more slots of the upright member, such that the retainer is configured to release from the upright member upon impact of the barrier by an errant vehicle and/or rider, thereby freeing the straps from the upright member, wherein the straps are held between the retainer and wherein the retainer is configured to continue to hold the straps after the release of the retainer from the upright member so as to maintain the straps in a pre-impacted relative arrangement.

2. The roadside crash barrier as claimed in claim 1, wherein the planar face of each elongate strap is perpendicular a surface of the road, and the barrier is configured to deflect errant vehicles back towards the road.

3. The roadside crash barrier as claimed in claim 1 wherein the planar face of each elongate strap comprises a surface that is relatively smooth, and/or continuous along the length of the strap.

4. The roadside crash barrier of claim 1, wherein each plug comprises a frangible section configured to break upon impact of the barrier by an errant vehicle and/or rider to facilitate disengagement of the one or more plugs from the one or more slots of the upright member.

5. The roadside crash barrier of claim 1, wherein the one or more plugs are composed of a deformable polymer material so as to facilitate disengagement of the one or more plugs from respective slots upon impact of the barrier by an errant vehicle and/or rider.

6. The roadside crash barrier of claim 5, wherein the deformable polymer material comprises nylon, epoxy resin, or silicone.

7. The roadside crash barrier of claim 5, wherein the deformable polymer material comprises a fibre reinforced polymer material.

8. The roadside crash barrier of claim 7, wherein the fibre material of the fibre reinforced polymer material comprises glass, carbon, aramid, or basalt.

9. The roadside crash barrier of claim 5, wherein the deformable polymer material is glass fibre reinforced nylon.

10. The roadside crash barrier of claim 1, wherein each slot of the upright member is vertically elongated such that the respective plug is moveable vertically within the slot.

11. The roadside crash barrier of claim 1, wherein the straps are configured to be tensioned to between 200 kN and 400 kN.

12. The roadside crash barrier of claim 1, wherein the retainer comprises an inner retainer and an outer retainer connected by the plugs, and the straps are held between the inner retainer and the outer retainer.

13. The roadside crash barrier of claim 1, wherein the retainer is significantly flush or planar with the external face of the straps.

14. The roadside crash barrier of claim 1, wherein the external surface of the retainer does not extend more than 6 mm past the external face of the straps.

15. A method of installing the roadside crash barrier of claim 1, comprising:

(i) inserting a ground anchor into the ground, the ground anchor being integral with the upright member, (ii) pressing each of the one or more plugs through a respective hole in the retainer, (iii) aligning each of the straps with the top of a respective plug, (iv) mounting the retainer to the upright member by engaging the plugs with the slots of the upright member including vertically slotting the ends of the plugs into the slots on the upright member.

16. The method of claim 15, wherein the ground anchor is a ground screw.

17. A method of installing the roadside crash barrier of claim 1, comprising:

(i) inserting a ground anchor into the ground, (ii) connecting the upright member to the ground anchor, (iii) pressing each of the one or more plugs through a respective hole in the retainer, (iv) aligning each of the straps with the top of a respective plug, (v) mounting the retainer to the upright member by engaging the plugs with the slots of the upright member including vertically slotting the ends of the plugs into the slots on the upright member.

18. The method of claim 17, wherein the ground anchor is a ground screw.

19. The method of claim 17, wherein connecting the upright member to the ground anchor comprises inserting the upright member into a socket of the ground anchor.

* * * * *